US007676188B2

(12) United States Patent
Hoshino

(10) Patent No.: US 7,676,188 B2
(45) Date of Patent: Mar. 9, 2010

(54) DEVELOPER CONVEYING MEMBER, DEVELOPER CONTAINER, IMAGE FORMING APPARATUS, AND METHOD OF ASSEMBLING A DEVELOPER CONVEYING MEMBER

(75) Inventor: Hirohisa Hoshino, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 204 days.

(21) Appl. No.: 12/028,052

(22) Filed: Feb. 8, 2008

(65) Prior Publication Data

US 2008/0240813 A1 Oct. 2, 2008

(30) Foreign Application Priority Data

Mar. 28, 2007 (JP) ..... 2007-085611

(51) Int. Cl.
*G03G 21/00* (2006.01)

(52) U.S. Cl. ..... 399/358

(58) Field of Classification Search ..... 399/358–360
See application file for complete search history.

(56) References Cited

U.S. PATENT DOCUMENTS 6,167,211 A * 12/2000 Oogi et al. ..... 399/53

FOREIGN PATENT DOCUMENTS

JP 2005-37663 A 2/2005

* cited by examiner

*Primary Examiner*—Hoang Ngo
(74) *Attorney, Agent, or Firm*—Sughrue Mion, PLLC

(57) ABSTRACT

A developer conveying member includes: a conveying member body; an end-portion supporting member; and a supported member including: a first radiation direction extending portion; and a second radiation direction extending portion, the end-portion supporting member including: a cylindrical portion, and the supporting portion defining: a through hole; and a groove.

11 Claims, 16 Drawing Sheets

DEVELOPER CONVEYING MEMBER, DEVELOPER CONTAINER, IMAGE FORMING APPARATUS, AND METHOD OF ASSEMBLING A DEVELOPER CONVEYING MEMBER

CROSS-REFERENCE TO RELATED APPLICATIONS

This application is based on and claims priority under 35 U.S.C. 119 from Japanese Patent Application No. 2007-085611 filed Mar. 28, 2007.

BACKGROUND

1. Technical Field

The present invention relates to a developer conveying member which transports a developer, a developer container which comprises the developer conveying member, an image forming apparatus which comprises the developer container, and method of assembling a developer conveying member.

2. Related Art

In a conventional image forming apparatus of the electrophotographic system, a latent image is formed on the surface of an image carrier, the latent image is developed to a visible image by a developer in a developing device, and the visible image is transferred and fixed to a medium to form an image. After the transfer of the visible image, a developer remaining on the surface of the image carrier, and paper dust adhering to the surface are removed away and recovered. A developer conveying member which conveys the developer is placed in a developing device in which the developer is conveyed, a path through which the developer is conveyed to the developing device, and a developer containing vessel which contains a developer for replenishment, or a path through which a recovered developer is conveyed, and a recovery container which contains the recovered developer.

SUMMARY

According to an aspect of the present invention, a developer conveying member including: a conveying member body that is rotated about a rotation axis to convey a developer in a conveying direction; an end-portion supporting member that supports the conveying member body and rotates; and a supported member that is supported by the end-portion supporting member of the conveying member, and that includes: a first radiation direction extending portion that extends in a first radial direction from the rotation axis of the conveying member body; and a second radiation direction extending portion that is formed continuously with an inner end portion of the first radiation direction extending portion in the first radial direction, that inclines in the first radial direction from the rotation axis of the conveying member body, and that extends in a second radial direction from the rotation axis of the conveying member body, the end-portion supporting member including: a cylindrical portion that includes a supporting portion supporting the supported portion of the conveying member body, and the supporting portion defining: a through hole that supports the second radiation direction extending portion, that is formed penetratingly from an axial recess to an outside of the cylindrical portion in the second radial direction, and that has an outer diameter that is larger than outer diameters of the first and second radiation direction extending portions; and a groove that supports the first radiation direction extending portion, that is formed penetratingly from an axial recess to an outside of the cylindrical portion in the first radial direction, and that is formed until an end portion of the cylindrical portion with a width being larger than the outer diameter of the first radiation direction extending portion.

BRIEF DESCRIPTION OF THE DRAWINGS

Exemplary embodiment of the present invention will be described in detail based on the following figures, wherein:

FIGS. 2A and 2B are views illustrating a developer container in Example 1 in which FIG. 2A is a perspective view, and FIG. 2B is a view illustrating a state where a lid in FIG. 2A is removed away;

FIGS. 3A to 3D are views illustrating a conveying member body in Example 1 in which FIG. 3A is a perspective view of the conveying member body, FIG. 3B is a side view of FIG. 3A, FIG. 3C is an end view as seen from the side of the arrow IIIC in FIG. 3B, and FIG. 3D is an end view as seen from the side of the arrow IIID in FIG. 3B;

FIGS. 4A to 4E are views illustrating an end-portion supporting member in Example 1 in which FIG. 4A is a side view, FIG. 4B is a view as seen in the direction of the arrow IVB in FIG. 4A, FIG. 4C is a view as seen in the direction of the arrow IVC in FIG. 4A, FIG. 4D is a view as seen in the direction of the arrow IVD in FIG. 4A, and FIG. 4E is a section view taken along the line IVE-IVE in FIG. 4C;

FIGS. 5A to 5F are views illustrating a method of assembling a developer conveying member in Example 1 of the invention in which FIG. 5A is a view illustrating a state where the conveying member body is separated from the end-portion supporting member, FIG. 5B is a view illustrating a state where, in the state shown in FIG. 5A, a first radiation direction extending portion is inserted into a radiation-direction through hole, FIG. 5C is a view illustrating a state where, in the state shown in FIG. 5B, the conveying member body is swung about a body rod-like portion, FIG. 5D is a view illustrating a state where, in the state shown in FIG. 5C, the conveying member body is further swung, FIG. 5E is a view illustrating a state where, in the state shown in FIG. 5D, the conveying member body is about the radiation-direction through hole, and FIG. 5F is a view illustrating a state where, in the state shown in FIG. 5E, the conveying member body is further swung to be attached;

FIGS. 6A to 6E are views illustrating an end-portion supporting member of Example 2 of the invention corresponding to FIG. 4 of Example 1 in which FIG. 6A is a side view, FIG. 6B is a view as seen in the direction of the arrow VIB in FIG. 6A, FIG. 6C is a view as seen in the direction of the arrow VIC in FIG. 6A, FIG. 6D is a view as seen in the direction of the arrow VID in FIG. 6A, and FIG. 6E is a section view taken along the line VIE-VIE in FIG. 6C;

FIGS. 7A to 7F are views illustrating a method of assembling the developer conveying member of Example 2 of the invention corresponding to FIG. 5 of Example 1 in which FIG. 7A is a view illustrating a state where the conveying member body is separated from the end-portion supporting member, FIG. 7B is a view illustrating a state where, in the state shown in FIG. 7A, the first radiation direction extending portion is inserted into the radiation-direction through hole, FIG. 7C is a view illustrating a state where, in the state shown in FIG. 7B, the conveying member body is swung about the body rod-like portion, FIG. 7D is a view illustrating a state where, in the state shown in FIG. 7C, the conveying member body is further swung, FIG. 7E is a view illustrating a state where, in the state shown in FIG. 7D, the conveying member body is about the radiation-direction through hole, and FIG. 7F is a view illustrating a state where, in the state shown in FIG. 7E, the conveying member body is further swung to be attached;

FIGS. 10A and 10B are views illustrating the conveying member body in Example 3 of the invention in which FIG. 10A is a side view of the conveying member body, and FIG. 10B is a view as seen in the direction of XB in FIG. 10A;

FIGS. 11A to 11E are views illustrating the end-portion supporting member in Example 3 of the invention corresponding to FIG. 4 of Example 1 in which FIG. 11A is a side view, FIG. 11B is a view as seen in the direction of XIB in FIG. 11A, FIG. 11C is a view as seen in the direction of XIC in FIG. 11A, FIG. 11D is a view as seen in the direction of XID in FIG. 11A, and FIG. 11E is a section view taken along the line XIE-XIE in FIG. 11C;

FIGS. 12A to 12E are views illustrating a method of assembling the developer conveying member in Example 3 of the invention in which FIG. 12A is a view illustrating a state where the conveying member body is separated from the end-portion supporting member, FIG. 12B is a view illustrating a state where, in the state shown in FIG. 12A, the first radiation direction extending portion is inserted into the radiation-direction through hole, FIG. 12C is a view illustrating a state where, in the state shown in FIG. 12B, the conveying member body is swung about the conveying portion, FIG. 12D is a view illustrating a state where, in the state shown in FIG. 12C, the conveying member body is further swung, and FIG. 12E is a view illustrating a state where, in the state shown in FIG. 12D, the conveying member body is further swung about the radiation-direction through hole to be attached;

FIGS. 13A and 13B are views illustrating a rotation state of the conveying member in Example 3 in which FIG. 13A is a view illustrating a coupling portion between the end-portion supporting member and the conveying member body in the rotation state shown in FIG. 9, and FIG. 13B is a view illustrating a state where, in the state shown in FIG. 13A, the end-portion supporting member is rotated by 180 degrees;

DETAILED DESCRIPTION

Figure 1:
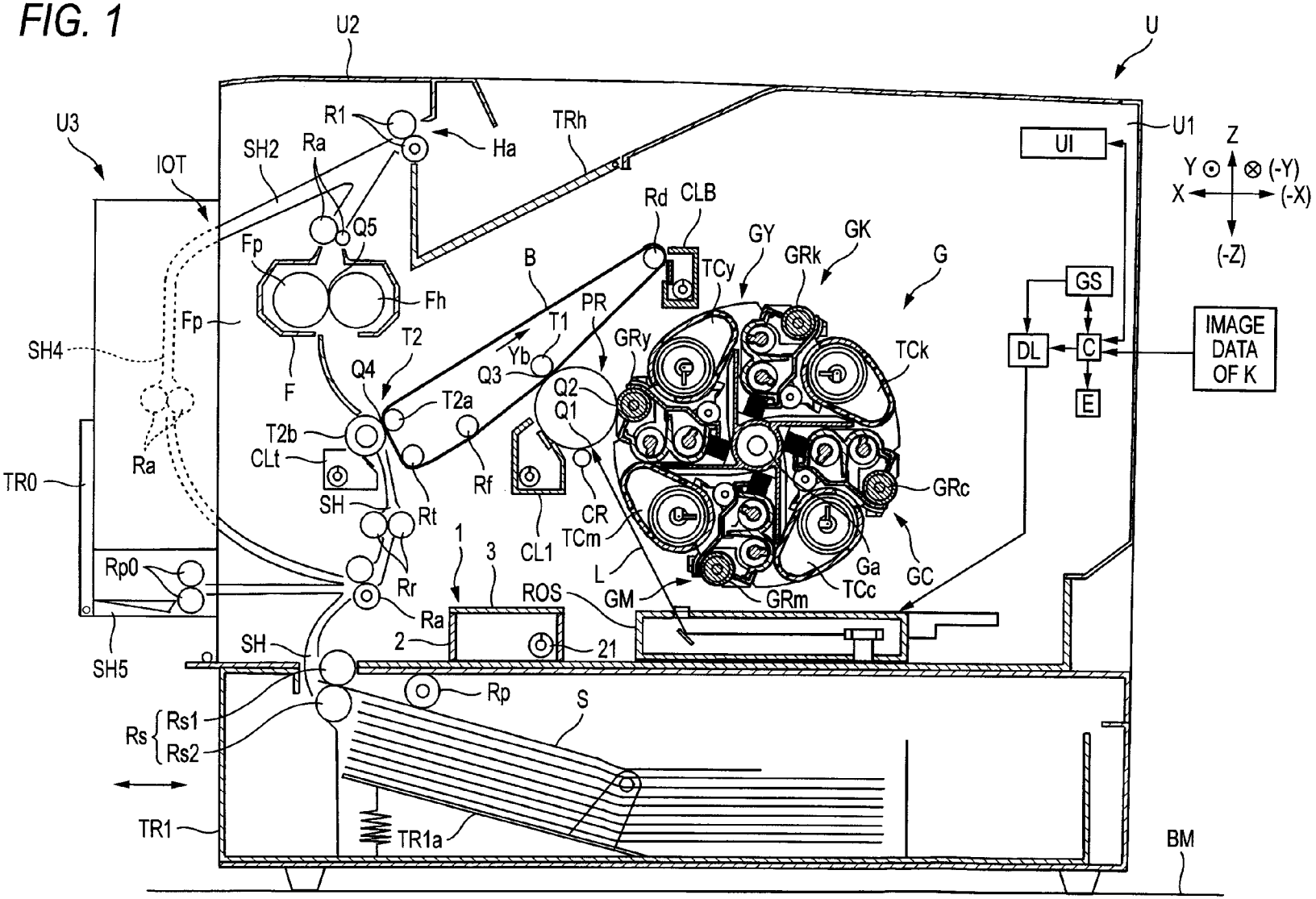
FIG. 1 is a diagram illustrating the whole of an image forming apparatus of Example 1 of the invention.

Next, exemplary embodiments (example) of the invention will be described with reference to the accompany drawings. However, the invention is not restricted to the following examples.

In order to facilitate the understanding of the following description, the front and rear directions in the drawings are indicated as X-axis directions, the right and left directions are indicated as Y-axis directions, and the upper and lower directions are indicated as Z-axis directions. The directions or sides indicated by the arrows X, −X, Y, −Y, Z, and −Z are the front, rear, right, left, upper, and lower directions, or the front, rear, right, left, upper, and lower sides, respectively.

In the figures, the symbol in which "●" is written in "○" indicates the arrow which is directed from the rear of the sheet to the front, and that in which "×" is written in "○" indicates the arrow which is directed from the front of the sheet to the rear. In Example 1, directions along which a sheet feeding tray is attached and detached are set as the rear and front directions.

In the following description with reference to the drawings, illustrations of members other than those which are necessary in description are suitably omitted for the sake of easy understanding.

Example 1

FIG. 1 is a diagram illustrating the whole of an image forming apparatus of Example 1 of the invention.

Referring to FIG. 1, a digital printer U which is an example of the image forming apparatus of Example 1 has an image forming apparatus body U1, and a sheet discharging tray TRh which is an example of a discharging portion is disposed on the upper face of the image forming apparatus body U1.

Referring to FIG. 1, the image forming apparatus body U1 has an operation portion UI which is to be operated by the user.

The image forming apparatus body U1 has: a controlling portion C; a laser driving circuit DL, and which is an example of a latent-image writing device driving circuit controlled by the controlling portion C; an image processing portion GS; a power source circuit E; and the like.

The image processing portion GS converts image data supplied from an external information processing apparatus or the like, to image data for writing, temporarily stores the image data, and supplies the image data as image data for forming a latent image, to the laser driving circuit DL at a predetermined timing.

In accordance with the supplied image data, the laser driving circuit DL supplies a laser driving signal to a latent-image forming device ROS. The latent-image forming device ROS emits a laser beam (image writing light) L for writing an image in accordance with the laser driving signal. The controlling portion C controls the operations of the image forming apparatus body U1, the image processing portion GS, the laser driving signal outputting device DL, the power source circuit E which applies a voltage to developing rolls GRy to GRk and transferring T1, T2*b* that will be described, and the like.

In an image carrier (photosensitive member) PR which is placed above the latent-image forming device ROS, and which is rotated, the surface is uniformly charged by a charging roll CR, and then exposed and scanned at a latent-image writing position Q1 by the laser beam L of the latent-image forming device ROS to form an electrostatic latent image. When a full-color image is to be formed, electrostatic latent images respectively corresponding to images of four colors of K (black), Y (yellow), M (magenta), and C (cyan) are sequentially formed. In the case of a monochromatic image, only an electrostatic latent image corresponding to an image of K (black) is formed.

The surface of the image carrier PR on which the electrostatic latent images are formed is rotatively moved to sequentially pass through a developing region Q2 and a primary transferring region Q3.

A rotary developing device G is placed above the latent-image forming device ROS. The rotary developing device G has developing devices GK, GY, GM, GC for the four colors of K (black), Y (yellow), M (magenta), and C (cyan) which are rotatively moved to the developing region Q2 in a sequential manner in accordance with rotation of a rotation shaft Ga. The color developing devices GK, GY, GM, GC have the developing rolls GRk, GRy, GRm, GRc which convey developers to the developing region Q2, and develop electrostatic latent images on the image carrier PR passing through the developing region Q2, to toner images.

Color toners are replenished from toner replenishment cartridges TCk, TCy, TCm, TCc to developer container of the developing devices GK, GY, GM, GC, respectively. The rotary developing device may employ one of various configurations which are conventionally known (for example, see JP-A-12-131942, JP-A-12-231250, etc.).

Referring to FIG. 1, an endless intermediate transfer belt B which is an example of an intermediate transferring member is placed above the image carrier PR. The intermediate transfer belt B is supported by: a driving roll Rd that is an example of a driving member for rotary drive; a primary transferring roll T1 that is an example of a primary transferring device to which a primary transfer voltage is applied; a tension roll Rt that is an example of a tension generating member which generates a tension in the intermediate transfer belt B; a backup roll T2*a* that is an example of a opposing member which is opposed to a secondary transferring member; and a free roll Rf that supports the intermediate transfer belt B. A belt supporting member (Rd, T1, Rf, Rt, T2*a*) is configured by the rolls Rd, T1, Rf, Rt, T2*a*.

The intermediate transfer belt B is rotatably movably supported by the driving roll Rd, and, during an image forming operation, rotated in the direction of the arrow Yb.

In the case where a multi-color image, i.e., a full-color image is to be formed, an electrostatic latent image of a first color is formed at the latent-image writing position Q1, and a toner image of the first color is formed in the developing region Q2. When the toner image passes through the primary transferring region Q3, the toner image is electrostatically primarily transferred onto the intermediate transfer belt B by the primary transferring roll T1. Onto the intermediate transfer belt B which carries the toner image of the first color, similarly, toner images of second, third, and fourth colors are sequentially primarily transferred in an overlapping manner, so that a full-color multiple toner image is finally formed on the intermediate transfer belt B.

In the case where a single- or mono-color image is to be formed, only one of the developing devices is used, and a single-color image is primarily transferred onto the intermediate transfer belt B.

After the primary transfer, the surface of the image carrier PR is cleaned by an image-carrier cleaner CL1 which is an example of an image-carrier cleaning device. The image carrier PR in which residual toner adhering to the surface has be recovered by the image-carrier cleaner CL1 is again charged by the charging roll CR.

At a position which is opposed to the backup roll T2*a*, a secondary transferring roll T2*b* which is an example of a secondary transferring member is placed so as to be movable between a position which is separated from the backup roll T2*a*, and that which is contacted therewith. A secondary transferring device T2 is configured by the backup roll T2*a* and the secondary transferring roll T2*b*. A secondary transferring region Q4 is formed by a contact region between the backup roll T2*a* and the secondary transferring roll T2*b*.

A secondary transfer voltage which is opposite to the charging polarity of the toner used in the developing device G is supplied from the power source circuit E to the secondary transferring roll T2*b*. The power source circuit E is controlled by the controlling portion C.

Referring to FIG. 1, the sheet feeding tray TR1 which is an example of a sheet feeding and medium housing portion houses recording sheets S which are an example of a medium to be conveyed to the secondary transferring region Q4, and supported so as to be movable along rails that are an example of a pair of guiding members placed in the front and rear directions on the right and left sides of the tray.

A sheet feeding device K is supported on the sheet feeding side of the sheet feeding tray TR1. A pickup roll Rp which is an example of a take-out member of the sheet feeding device K takes out a recording sheet S stacked on the sheet feeding tray TR1, in accordance with a sheet feeding timing. The recording sheet S is separated one by one in a press contact region between a feed roll Rs1 which is an example of a transporting member, and a separating roll Rs that is an example having a retard roll Rs2 which is an example of a pressing member, and conveyed to a sheet conveying path SH which is an example of a medium conveying path. The recording sheet S in the sheet conveying path SH is conveyed to a registration roll Rr which is an example a sheet supply timing adjusting member, by a sheet conveying roll Ra which is an example of plural medium conveying members placed along the sheet conveying path SH. The registration roll Rr conveys the recording sheet S to the secondary transferring region Q4 at a predetermined timing.

Also the recording sheet S fed from a manual feeding tray TR0 which is an example of a manual sheet feeding portion is conveyed in a manual sheet conveying path SH5, and conveyed to the secondary transferring region Q4 by the sheet conveying roll Ra and registration roll Rr which are placed along the sheet conveying path SH.

The toner images on the intermediate transfer belt B are secondarily transferred by the secondary transferring device T2 onto the recording sheet S passing through the secondary transferring region Q4. After the secondary transfer, a toner which remains on the surface of the intermediate transfer belt B is recovered by a belt cleaner CLB which is an example of an intermediate-transfer member cleaning device, thereby performing a cleaning operation. Furthermore, paper dust and the like adhering to the secondary transferring roll T2*b* are removed away by a secondary transferring roll cleaner CLt which is an example of a secondary transferring device cleaner.

The recording sheet S onto which the unfixed toner images have been transferred in the secondary transferring region Q4 is conveyed to a fixing region Q5 in a state where the toner images are in the unfixed state. The fixing device F heats, presses, and fixes the toner images in the fixing region Q5 where a heating roll Fh which is an example of a heating rotary member is contacted with a pressurizing roll Fp which is an example of a pressurizing rotary member. The recording sheet S on which the fixed toner images are formed is conveyed to discharging rolls R1 which are an example of a discharging member, and discharged to the sheet discharging tray TRh from a discharge port Ha.

In the printer U, a body inverting path SH2 connected to the sheet discharge port Ha is disposed. A sheet inverting device U3 which is an example of a medium inverting device is attached to an upper portion of the manual feeding tray TR0. An option-sheet inverting path SH4 which is an example of an inverting path to be connected to the body inverting path SH2 is formed in the sheet inverting device U3. In the double-sided printing, therefore, the sheet S onto which the toner image has been fixed in the developing region Q2 passes through the body sheet inverting path SH2 and the option-sheet inverting path SH4, conveyed to the registration roll Rr, and again sent to the secondary transferring region Q4 in a state where the sides of the sheet S are inverted.

A sheet inverting path (SH2+SH4) is configured by the body sheet inverting path SH2 and the option sheet inverting path SH4.

A sheet transporting member (Rp, Rs, Ra, R1) is configured by the pickup roll Rp, the separating roll Rs, the sheet conveying roll Ra, and the discharging rolls R1.

(Description of Developer Container)

Figure 2A:
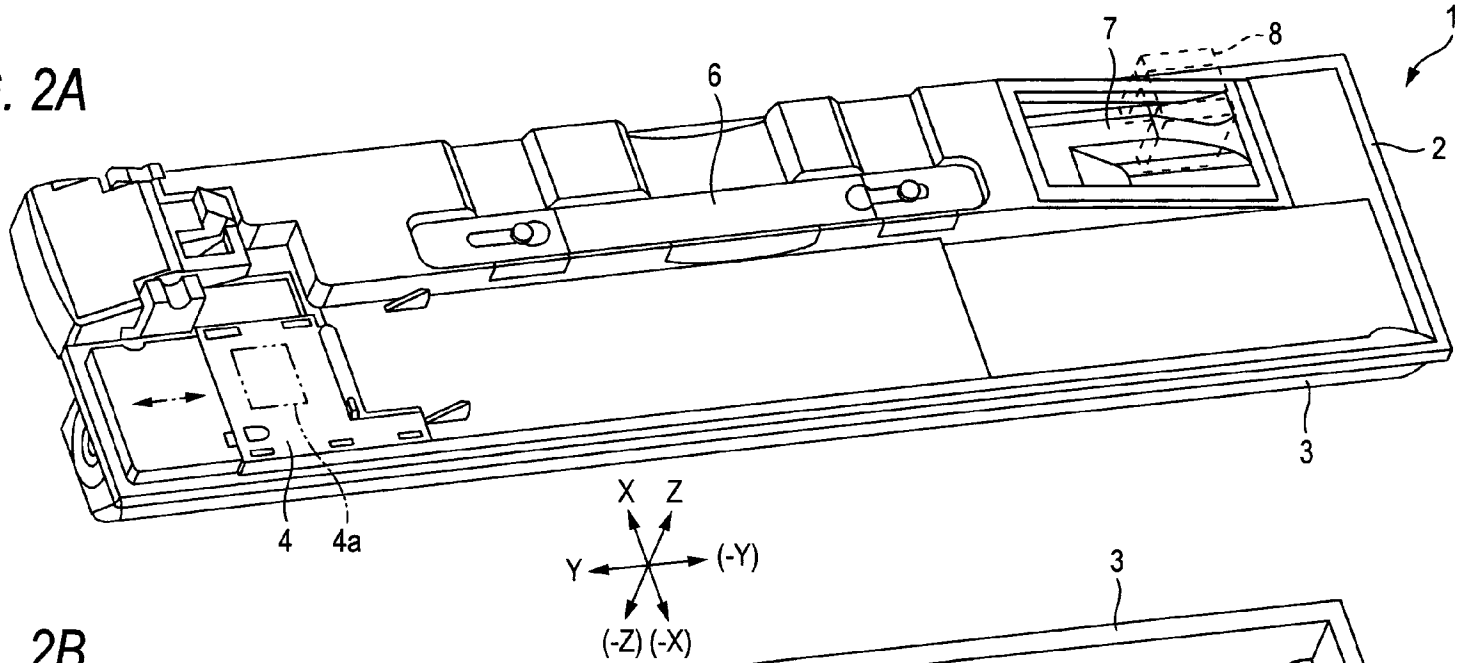
Figure 2B:
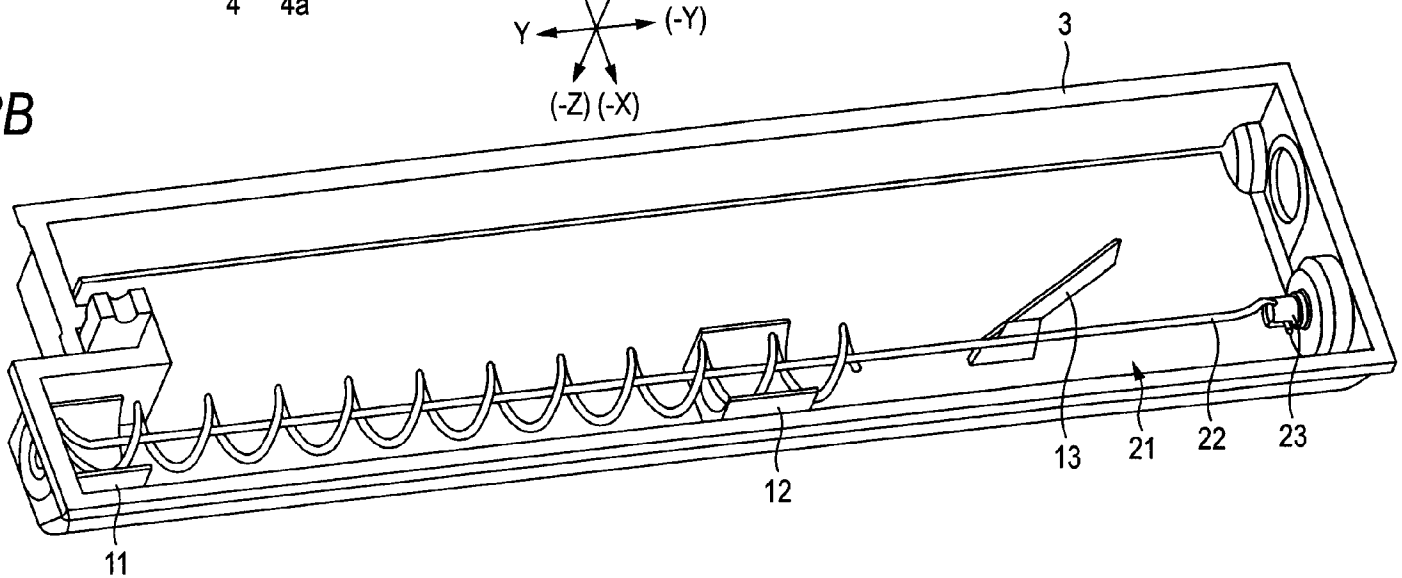

FIG. 2 is a view illustrating the developer container in Example 1 in which FIG. 2A is a perspective view, and FIG. 2B is a view illustrating a state where a lid in FIG. 2A is removed away.

Referring to FIG. 1, a recovery container 1 which is an example of a developer container configured so as to be attachable, detachable, and replaceable through the right side face with respect to the image forming apparatus body U1 is placed below the intermediate transfer belt B. Into the recovery container 1, the developer, paper dust, discharge products, and the like which are recovered by the image-carrier cleaner CL1, the belt cleaner CLB, and the secondary transferring roll cleaner CLt are conveyed by a conveying device which is not shown.

Referring to FIG. 2, the recovery container 1 has a container body 2 which is an example of a developer containing vessel, and a cover 3 which is an example of a lid member that covers the upper face of the container body 2. In FIG. 2A, a shutter 4 which is an example of an opening/closing member that is openingly and closingly moved in conjunction with attachment and detachment of the recovery container 1 is movably supported on the cover 3. When the shutter 4 is moved, an inflow port 4*a* into which the recovered developer and the like flows is formed. A griping portion 6 for being gripped when the recovery container 1 is to be replaced by the user is disposed in the front side of the cover 3, i.e., the +X side in FIG. 2.

In FIG. 2A, a projection 7 for determining whether the recovery container 1 is filled or not is disposed in a left portion of the front side of the cover 3, i.e., the +X side and the −Y portion in FIG. 2. In the case where the container is not filled with the developer, light of an optical sensor 8, and which is an example of a full-detecting member placed across the projection 7 passes, and, in the case where the container is filled with the developer and the developer enters into the projection 7, the light is blocked by the developer, and the optical sensor 8 detects that the container is filled.

In FIG. 2B, in a rear portion of the container body 2, i.e., the −X portion in FIG. 2, conveying member supporting portions 11, 12 having a semiarcuate upper face are formed, and a rectifying member 13 which is more inclined from the rear side (−X side) toward the front side (+X side) as further advancing toward the left side (−Y side) is formed in the left side (−Y side). Therefore, a part of the developer in the container body 2 is conveyed toward the projection 7 by the rectifying member 13.

Figure 3D:
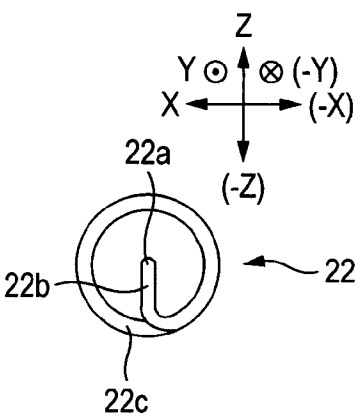
Figure 3C:
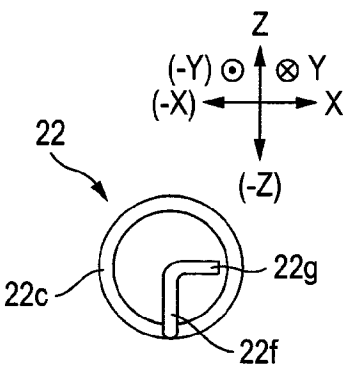
Figure 3A:
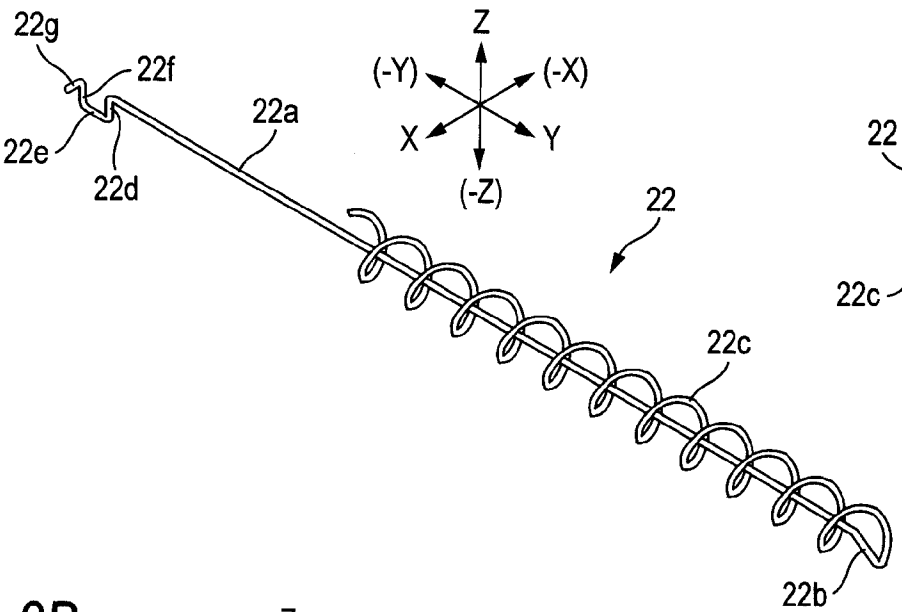
Figure 3B:
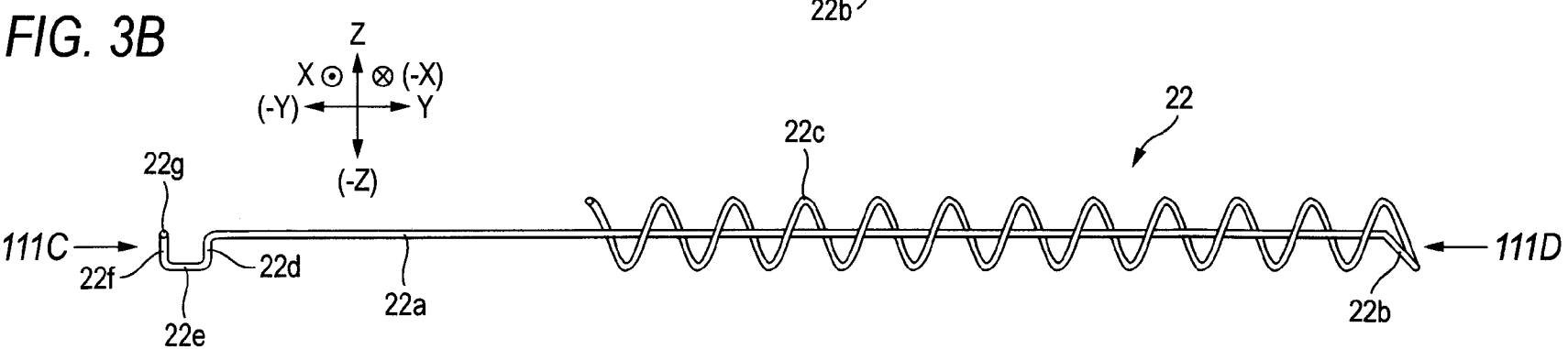

FIG. 3 is a view illustrating a conveying member body in Example 1 in which FIG. 3A is a perspective view of the conveying member body, FIG. 3B is a side view of FIG. 3A, FIG. 3C is an end view as seen from the side of the arrow IIIC in FIG. 3B, and FIG. 3D is an end view as seen from the side of the arrow IIID in FIG. 3B.

Figure 4B:
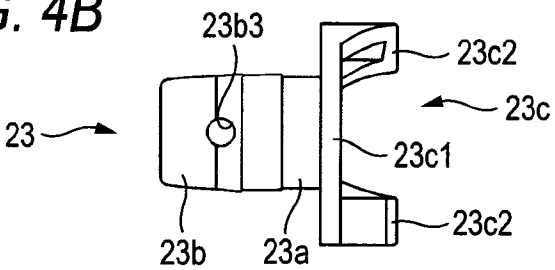
Figure 4A:
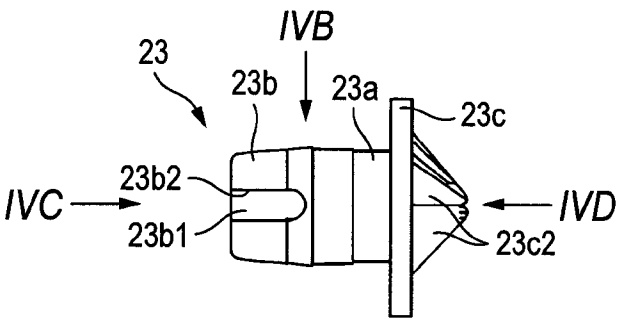
Figure 4D:
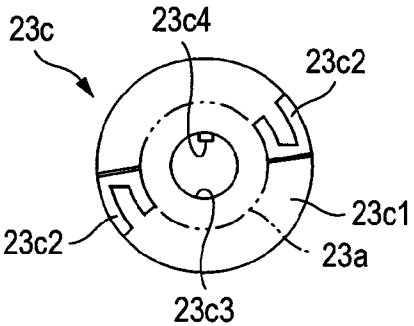
Figure 4C:
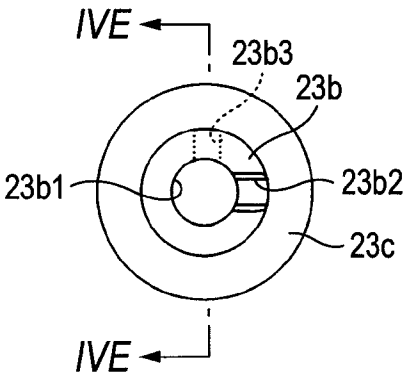
Figure 4E:
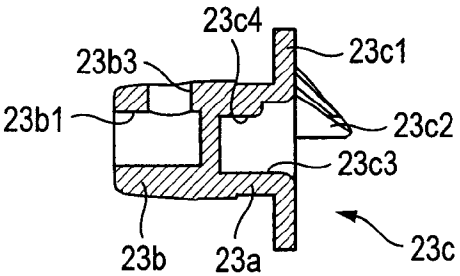

FIG. 4 is a view illustrating an end-portion supporting member in Example 1 in which FIG. 4A is a side view, FIG. 4B is a view as seen in the direction of the arrow IVB in FIG. 4A, FIG. 4C is a view as seen in the direction of the arrow IVC in FIG. 4A, FIG. 4D is a view as seen in the direction of the arrow IVD in FIG. 4A, and FIG. 4E is a section view taken along the line IVE-IVE in FIG. 4C.

In FIG. 2, a developer conveying member 21 is rotatably supported on the rear side (+X side) of the container body 2. Referring to FIGS. 2 to 4, the developer conveying member 21 has the conveying member body 22, and the end-portion supporting member 23 which supports a left end portion (−Y end portion) of the conveying member body 22.

Referring to FIG. 3, the conveying member body 22 has a body rod-like portion 22*a* which extends in the right and left directions or in the axial direction. In a right end side or one end portion of the body rod-like portion 22*a*, a coupling portion 22*b* which obliquely extends in a radiation direction (radial direction) with respect to the rotation axis is formed. A helical conveying portion 22*c* which leftward extends is integrally coupled to the coupling portion 22*b*. In the conveying member body 22 in Example 1, as shown in FIG. 2B, the left end of the conveying portion 22*c* is set between the left conveying member supporting portion 12 and the rectifying member 13.

In the other end portion of the body rod-like portion 22*a* or the left end side (−Y end side), a second radiation direction bent portion 22*d* which extends from the center in a lower direction or a second radiation direction is formed. An axial extending portion 22*e* is formed so as to axially extend from an external end portion in a radiation direction of the second radiation direction bent portion 22*d*. At the left end of the axial extending portion 22*e*, a second radiation direction extending portion 22*f* which extends toward the rotation center along a second radiation direction is formed in a bent shape. A first radiation direction extending portion 22*g* which extends in a first radiation direction that is inclined with respect to the second radiation direction is formed on the side of the rotation center of the second radiation direction extending portion 22*f*. In Example 1, the second radiation direction is perpendicular to the first radiation direction. A supported portion (22*g*+22*f*) supported by the end-portion supporting member 23 is configured by the first radiation direction extending portion 22*g* and the second radiation direction extending portion 22*f*.

Referring to FIG. 4, the end-portion supporting member 23 has: a supported portion 23*a* which is rotatably supported via a bearing by the left end wall of the container body 2; a cylindrical portion 23*b* which is formed on the supported portion 23*a* and on the inner side of the container body 2; and an engaging portion 23*c* which is an example of a driving receiving portion placed on the supported portion 23*a* and outside the container body 2.

An axial recess 23*b*1 which extends in the axial direction of the end-portion supporting member 23 is formed in a center portion of the cylindrical portion 23*b*. An axial groove 23*b*2 which is an example of a groove that extends in the axial direction, and that penetrates in the first radiation direction from the axial recess 23*b*1 to the outside is formed in the outer circumference of the cylindrical portion 23*b*. In Example 1, the width of the axial groove 23*b*2 is larger than the outer diameter of the second radiation direction extending portion 22*f*.

A radiation-direction through hole 23*b*3 which is an example of a round hole-like through hole penetrating in the second radiation direction from the axial recess 23*b*1 to the outside is formed in the outer circumference of the cylindrical portion 23*b*. In Example 1, the radiation-direction through hole 23*b*3 is formed so as to be larger in outer diameter than the first radiation direction extending portion 22*g* and the second radiation direction extending portion 22*f*.

A supporting portion in Example 1 which supports an end portion of the conveying member body 22 is configured by the axial recess 23*b*1, the axial groove 23*b*2, and the radiation-direction through hole 23*b*3.

The engaging portion 23*c* has a disk portion 23*c*1. Two engaging claws 23*c*2 are integrally formed on the left end face of the disk portion 23*c*1. When the recovery container 1 is attached to the image forming apparatus body U1, the engaging claws 23*c*2 engage with claws (not shown) of the image forming apparatus body U1 to transmit the driving force. In Example 1, the rotation direction in the case where the driving force is transmitted to the engaging portion 23*c* is set to a clockwise direction in FIG. 4D, and an angle from the radiation-direction through hole 23*b*3 to the axial groove 23*b*2 in the rotation direction is set to be larger than that from the axial groove 23*b*2 to the radiation-direction through hole 23*b*3.

A recess 23*c*3 which axially extends is formed in an axial center portion of the engaging portion 23*c* and the supported portion 23*a*. A key 23*c*4 for, when the developer conveying member 21 is to be attached to the container body 2, enabling a jig (not shown) to determine the rotation position of the developer conveying member 21 is formed in the recess 23*c*3.

(Method of Assembling Developer Conveying Member)

Figure 5A:
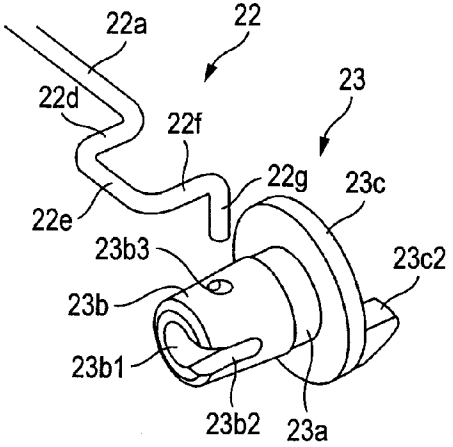
Figure 5B:
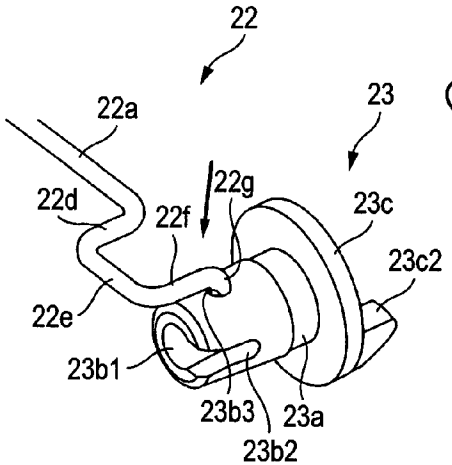
Figure 5C:
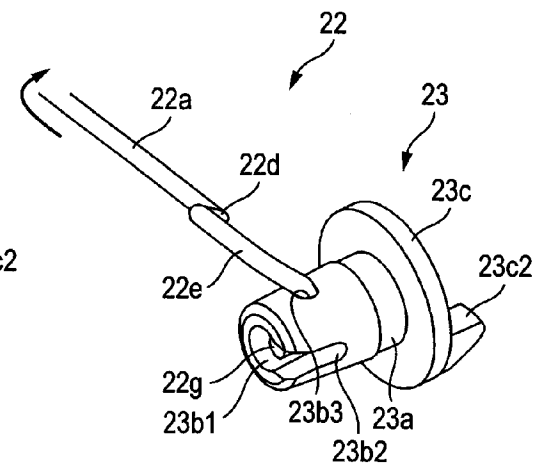
Figure 5D:
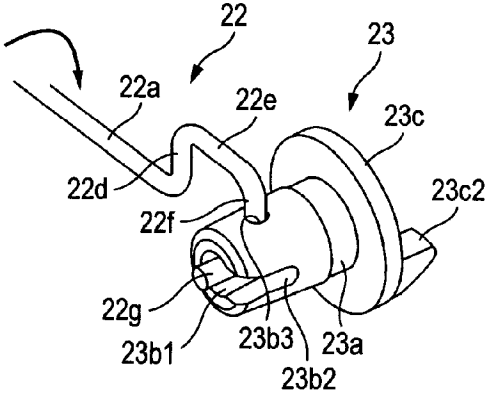
Figure 5E:
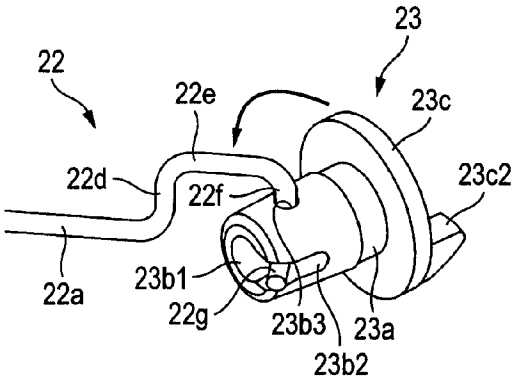
Figure 5F:
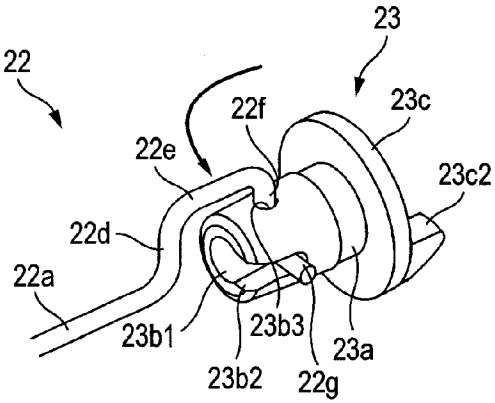

FIG. 5 is a view illustrating a method of assembling the developer conveying member in Example 1 of the invention in which FIG. 5A is a view illustrating a state where the conveying member body is separated from the end-portion supporting member, FIG. 5B is a view illustrating a state where, in the state shown in FIG. 5A, the first radiation direction extending portion is inserted into the radiation-direction through hole, FIG. 5C is a view illustrating a state where, in the state shown in FIG. 5B, the conveying member body is swung about the body rod-like portion, FIG. 5D is a view illustrating a state where, in the state shown in FIG. 5C, the conveying member body is further swung, FIG. 5E is a view illustrating a state where, in the state shown in FIG. 5D, the conveying member body is about the radiation-direction through hole, and FIG. 5F is a view illustrating a state where, in the state shown in FIG. 5E, the conveying member body is further swung to be attached.

The manner of assembling the developer conveying member 21 will be described with reference to FIG. 5. In a through hole inserting step, in a state where the end-portion supporting member 23 is separated from the conveying member body 22 as shown in FIG. 5A, first, the first radiation direction extending portion 22*g* is inserted into the radiation-direction through hole 23*b*3 of the end-portion supporting member 23 as shown in FIG. 5B.

In a rotation axis direction moving step, in the state shown in FIG. 5B, next, the conveying member body 22 is relatively swung with respect to the end-portion supporting member with setting the body rod-like portion 22*a* as a swing center. Then, the state shown in FIG. 5D is obtained via the state shown in FIG. 5C, and the first radiation direction extending portion 22*g* enters into the axial recess 23*b*1.

In a groove attaching step, next, the conveying member body 22 is swung with setting the radiation-direction through hole 23*b*3 as a center to attain the state shown in FIG. 5F via the state shown in FIG. 5E, and the conveying member body 22 is attached to the end-portion supporting member 23.

In this way, the developer conveying member 21 is assembled from the end-portion supporting member 23 and the conveying member body 22. In this state, the developer conveying member 21 is attached to the container body 2 to perform the assembling.

Function of Example 1

In the image forming apparatus U of Example 1 having the above-described configuration, when the recovery container 1 is attached to the image forming apparatus body U1, the driving can be transmitted to the developer conveying member 21. When the image forming operation is performed in this state, the developer conveying member 21 is rotated to convey the developer flowing through the inflow port 4*a* of the recovery container 1, in the conveying direction, i.e., from the right side (+Y side) to the left side (−Y side).

In the recovery container 1 of Example 1, in the case where the container is to be replaced or taken out from a package, even when the container is dropped or contacted with the image forming apparatus body U1 to generate a shock, the conveying member body 22 is prevented from being axially disengaged because the conveying member body is penetrated through and supported by the radiation-direction through hole 23*b*3. Moreover, the fitting of the second radiation direction extending portion 22*f* into the radiation-direction through hole 23*b*3 prevents also the separation in the first radiation direction from occurring, and the first radiation direction extending portion 22*g* fitted into the axial groove 23*b*2 prevents also the separation in the second radiation direction from occurring. In the end-portion supporting member 23 when the driving is transmitted, furthermore, the angle from the radiation-direction through hole 23*b*3 to the axial groove 23*b*2 in the rotation direction is set to be larger than that from the axial groove 23*b*2 to the radiation-direction through hole 23*b*3, whereby, when receiving a force due to rotation, the movement of the conveying member body 22 in the separation direction is restricted by the radiation-direction through hole 23*b*3 to prevent the separation from occurring.

Therefore, it is not necessary to accurately produce the inner shape of the recovery container 1 so that the developer conveying member 21 is prevented from slipping off by a contact with the recovery container 1. The developer conveying member 21 and the recovery container 1 can be produced while avoiding the production cost from rising.

Example 2

Figure 6B:
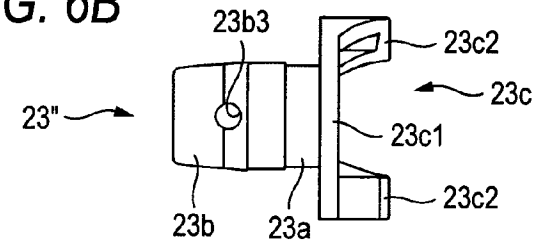
Figure 6A:
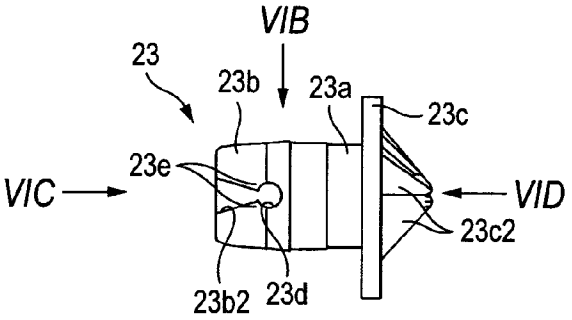
Figure 6D:
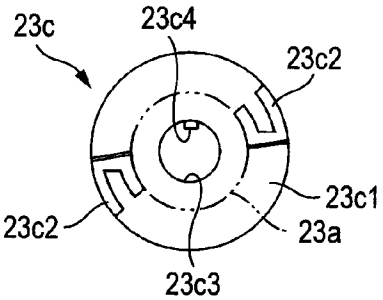
Figure 6C:
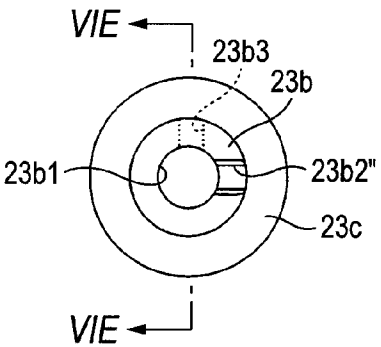
Figure 6E:
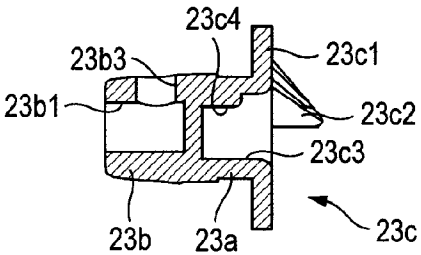

FIG. 6 is a view illustrating an end-portion supporting member of Example 2 of the invention corresponding to FIG. 4 of Example 1 in which FIG. 6A is a side view, FIG. 6B is a view as seen in the direction of the arrow VIB in FIG. 6A, FIG. 6C is a view as seen in the direction of the arrow VIC in FIG. 6A, FIG. 6D is a view as seen in the direction of the arrow VID in FIG. 6A, and FIG. 6E is a section view taken along the line VIE-VIE in FIG. 6C.

Next, Example 2 of the invention will be described. In the description of Example 2, the components corresponding to those of Example 1 are denoted by the same reference numerals, and their detailed description is omitted.

Example 2 is configured in the same manner as Example 1 except following point.

Referring to FIG. 6, in the end-portion supporting member 23 in Example 2, a hole 23*d* corresponding to the shape of the first radiation direction extending portion 22*g* is formed in an inner end portion of the axial groove 23*b*2, and a fit fixing portion 23*e* which is narrower in width than the hole 23*d* is formed in the outside of the hole 23*d*.

(Method of Assembling Developer Conveying Member)

Figure 7A:
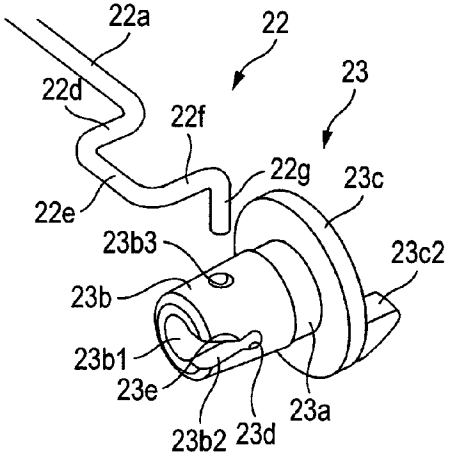
Figure 7B:
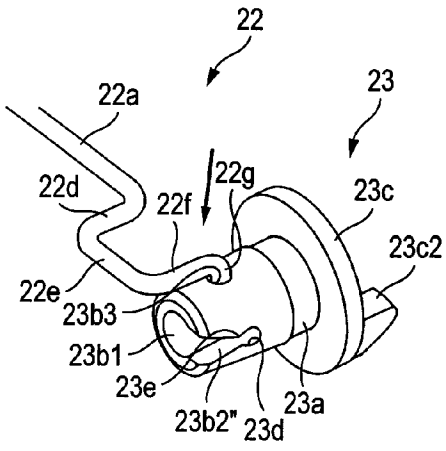
Figure 7C:
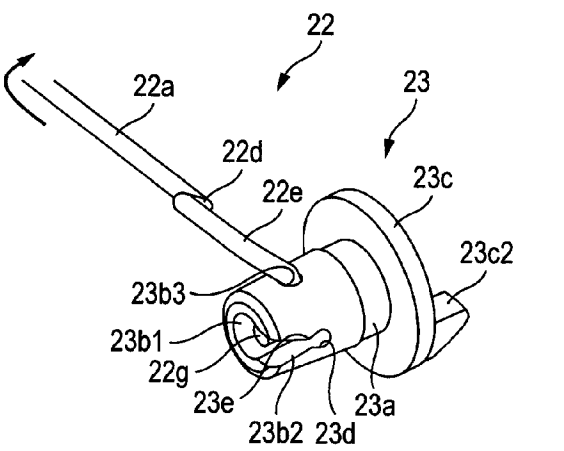
Figure 7D:
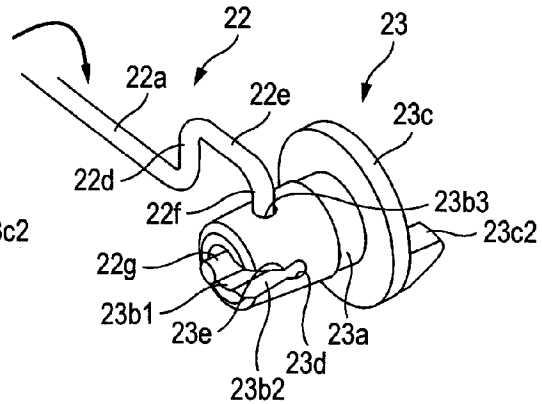
Figure 7E:
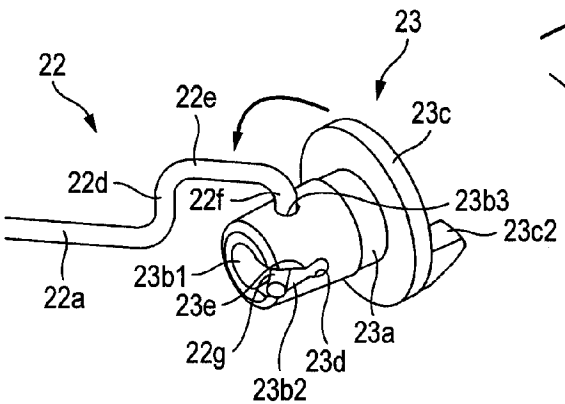
Figure 7F:
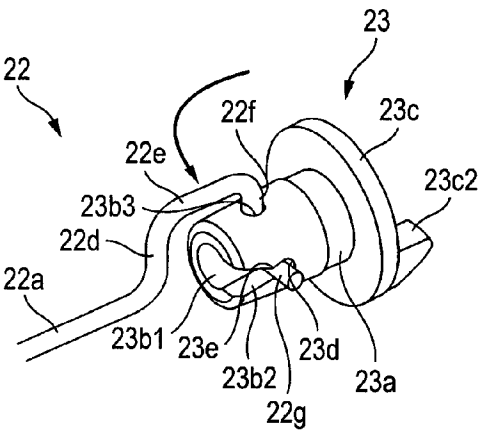

FIG. 7 is a view illustrating a method of assembling the developer conveying member of Example 2 of the invention corresponding to FIG. 5 of Example 1 in which FIG. 7A is a view illustrating a state where the conveying member body is separated from the end-portion supporting member, FIG. 7B is a view illustrating a state where, in the state shown in FIG. 7A, the first radiation direction extending portion is inserted into the radiation-direction through hole, FIG. 7C is a view illustrating a state where, in the state shown in FIG. 7B, the conveying member body is swung about the body rod-like portion, FIG. 7D is a view illustrating a state where, in the state shown in FIG. 7C, the conveying member body is further swung, FIG. 7E is a view illustrating a state where, in the state shown in FIG. 7D, the conveying member body is about the radiation-direction through hole, and FIG. 7F is a view illustrating a state where, in the state shown in FIG. 7E, the conveying member body is further swung to be attached.

Referring to FIG. 7, the conveying member body 22 is fitted into the end-portion supporting member 23 in the sequence of FIGS. 7A to 7E corresponding to FIGS. 5A to 5E in Example 1. When the conveying member body 22 is swung in the state shown in FIG. 7E, the fit fixing portion 23*e* is elastically deformed, and the first radiation direction extending portion 22*g* pressingly widens the fit fixing portion 23*e* to be fitted into and fixed to the hole 23*d*. As a result, the state of FIG. 7F is obtained, and the conveying member body 22 is attached to the end-portion supporting member 23, so that the developer conveying member 21 is assembled.

Function of Example 2

In the recovery container 1 of Example 2 having the above-described configuration, the first radiation direction extending portion 22*g* is fixed in the fitted state by the fit fixing portion 23*e*, and the conveying member body 22 is further effectively prevented from slipping off because of a shock or the like.

The recovery container 1 of Example 2 exerts the other effects which are identical with those of Example 1.

Example 3

Figure 8:
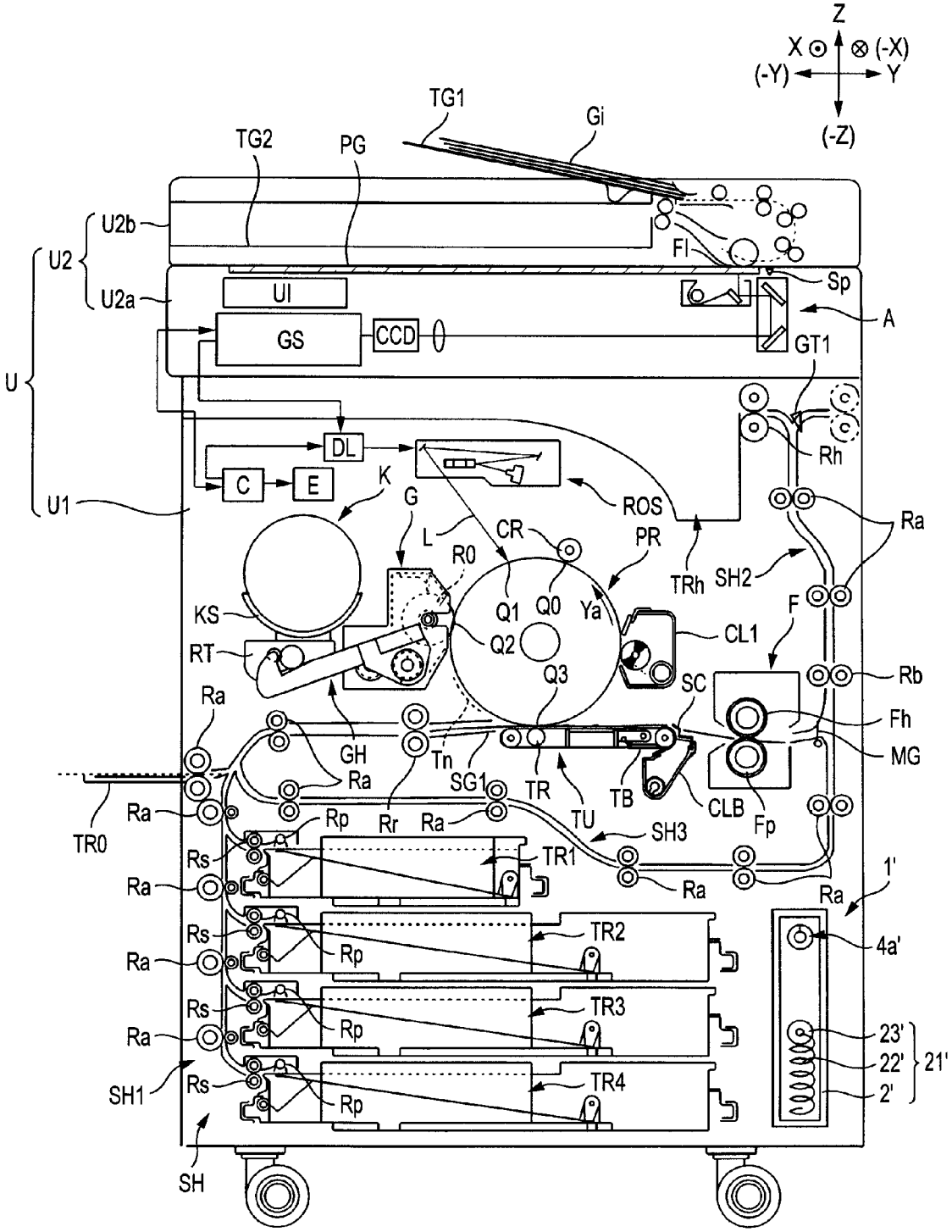
FIG. 8 is a diagram illustrating an image forming apparatus of Example 3 of the invention.

FIG. 8 is a diagram illustrating an image forming apparatus of Example 3 of the invention.

Next, Example 3 of the invention will be described. In the description of Example 3, the components corresponding to those of Example 1 are denoted by the same reference numerals, and their detailed description is omitted.

Example 3 is configured in the same manner as Example 1 except following point.

Referring to FIG. 8, a copier U which is an example of the image forming apparatus of the invention has a printer section U1 which is an example of an image recording portion, and a scanner section U2 which is an example of an image reading portion. The scanner section U2 comprises a reading portion body U2*a* having a platen glass PG which is an example a transparent document table, in the upper face, and an automatic document conveying device U2*b* which is attached above the platen glass PG.

The automatic document conveying device U2*b* has a document housing portion TG1 in which plural documents G to be copied are housed in a stacked manner, and is configured so that the plural documents G housed in the document housing portion TG1 are sequentially passed through a copying position on the platen glass PG to be discharged to a document discharging portion TG2.

The reading portion body U2*a* has: a user interface UI which is an example of the operation portion; an exposing system registration sensor Sp which is an example of an exposing system position detecting member placed at a platen registration position that is an example of a reading reference position; and an exposing optical system A.

The moving and stopping operations of the exposing optical system A are controlled in accordance with a detection signal of the exposing system registration sensor Sp. Usually, the system is stopped at the reference position.

In the case of an automatic document copying operation in which a copying operation is performed with using the automatic document conveying device U2*b*, the exposing optical systemA exposes documents G which are sequentially passed through the copying position F1 on the platen glass PG, in a state where the exposing optical system is stopped at the reference position.

In the case of a manual copying operation in which a copying operation is performed while the user manually places the document G on the platen glass PG, the exposing optical system A exposes and scans the document on the platen glass PG while the system is moving.

Reflected light from the exposed document G passes through the exposing optical system A to be converged on a solid-state imaging element CCD. The solid-state imaging element CCD converts the document reflected light converged on the imaging plane, to an electric signal.

The image processing portion GS converts the read image signal supplied from the solid-state imaging element CCD to a digital image writing signal, and supplies the image writing signal to the laser driving signal outputting device DL of the printer section U1.

The laser driving signal outputting device DL supplies a laser driving signal corresponding to the input image data, to the latent-image forming device ROS.

The image carrier PR which is placed below the latent-image forming device ROS is rotated in the direction of the arrow Ya. The surface of the image carrier PR is charged in a charging region Q0 by the charging roll CR, and thereafter exposed and scanned at the latent-image writing position Q1 by the laser beam L which is latent-image writing light of the latent-image forming device ROS, thereby forming an electrostatic latent image. The surface of the image carrier PR on which the electrostatic latent image is formed is rotatively moved to sequentially pass through the developing region Q2 and the transferring region Q3.

The developing device G which develops the electrostatic latent image in the developing region Q2 conveys the developer to the developing region Q2 by a developing roll R0, and develops the electrostatic latent image passing through the developing region Q2, to a toner image.

A developer cartridge K which is an example of a replenishment cartridge for replenishing the developer consumed in the developing device G is detachably attached to a cartridge attaching member KS that is an example of a replenishment container attaching member. The developer in the developer cartridge K is stirred in a reserve tank RT which is an example of a developer discharging container, and then conveyed to the developing device G by a developer conveying device GH. The configuration for conveying the developer in the developer cartridge K detachably attached to the cartridge attaching member KS, to the reserve tank RT is disclosed in, for example, JP-A-2003-84555, and conventionally known. Therefore, its detailed description is omitted.

A transferring unit TU which is placed in the transferring region Q3 with being opposed to the image carrier PR has an endless transfer belt TB which is an example of a transferring and conveying member. The transfer belt TB is rotatably supported by a belt supporting roll (Rd, Rf) having: the driving roll Rd which is an example of a driving member; and a driven roll Rf which is an example of a driven member.

A transferring roll TR which is an example of a transferring device opposed to the image carrier PR is placed in the transfer belt TB. A separation claw SC, and a belt cleaner CLB which is an example of a cleaning device for transferring and conveying members are placed on the downstream side of the transfer belt TB in the sheet conveying direction. The transferring roll TR is a member which transfers the tone image on the surface of the photosensitive drum PR to the sheet S, and to which the transfer voltage that is opposite to the charging polarity of the toner used in the developing device G is supplied from the power source circuit E. The power source circuit E is controlled by a controller C.

The sheet S which is an example of media housed in sheet feeding trays TR1 to TR4 that are an example of a sheet container is conveyed through a supply path SH1 to the transferring region Q3. Namely, sheets S in the trays TR1 to TR4 are taken out at a predetermined timing by the pickup roll Rp which is an example of a medium take-out member, separated one by one by the separating roll Rs which is an example of a medium separating member, and then conveyed by plural conveying rolls Ra to the registration roll Rr which is an example a conveyance timing adjusting member.

The sheet S conveyed to the registration roll Rr is conveyed from a pre-transfer guiding member SG1 to the transfer belt TB of the transferring unit TU in timing with the movement of the toner image on the image carrier PR to the transferring region Q3. The transfer belt TB conveys the conveyed sheet S to the transferring region Q3.

In the transferring region Q3, the toner image Tn developed on the surface of the image carrier PR is transferred to the sheet S by the transferring roll TR. After the transfer, the surface of the image carrier PR is cleaned by the photosensitive member cleaner CL1 so that residual toner is removed away, and then again charged by the charging roll CR.

The sheet S onto which the toner image has been transferred by the transferring roll TR in the transferring region Q3 is peeled from the surface of the transfer belt TB by the sheet separation claw SC on the downstream side of the transferring region Q3. In the peeled sheet S, the toner image is heat-fixed by the fixing device F having the heating roll Fh and the pressurizing roll Fp. The sheet S which has undergone the heating and fixing process is passed through a mylar gate MG which is an example of a conveying direction restricting member, and which is formed by an elastic sheet, and conveyed to a conveying roll Rb which is in a sheet discharging path SH2, and which can be rotated forwardly and reversely. The mylar gate MG is elastically deformed to direct the sheet S which has been passed through the fixing device F, to the discharging path SH2.

The sheet S which is to be discharged to a sheet discharge tray Rh that is an example of a recorded medium discharging portion is conveyed through the discharging path SH2 in which the conveying roll Rb that can be rotated forwardly and reversely, and the plural conveying rolls Ra are placed. A switching gate GT1 which is an example of a switching member is placed in a downstream end portion of the discharging path SH2. In the case where a post-processing apparatus (not shown) is connected to the image forming apparatus, the switching gate GT1 is switched so that the conveyed sheet S is discharged to one of the sheet discharging tray TRh and the post-processing apparatus which is not shown. In the case where a post-processing apparatus is not connected, the switching gate GT1 is switched so that the sheet S conveyed to the downstream end portion of the discharging path SH2 is discharged to the sheet discharging tray TRh.

In the case of double-sided printing, the conveying roll Rb which can be rotated forwardly and reversely is reversely rotated immediately before the rear end of the sheet S on one side of which printing has been performed passes over the conveying roll Rb, so that the one-side printed sheet S is reversely conveyed or subjected to the so-called switch-back operation. The mylar gate MG causes the sheet S which is switched back by the conveying roll Rb, to be directed toward a circulate conveying path SH3. The one-side printed sheet S which is conveyed to the circulate conveying path SH3 is again sent to the transferring region Q3 in a state where the sheet is inverted. In the one-side printed sheet S which is again sent to the transferring region Q3, a toner image is transferred to the second face.

A sheet conveying device SH is configured by the components denoted by the reference characters SH1 to SH3, Rp, Rs, Rr, Ra, Rb, MG, etc.

(Description of Developer Container)

Figure 9:
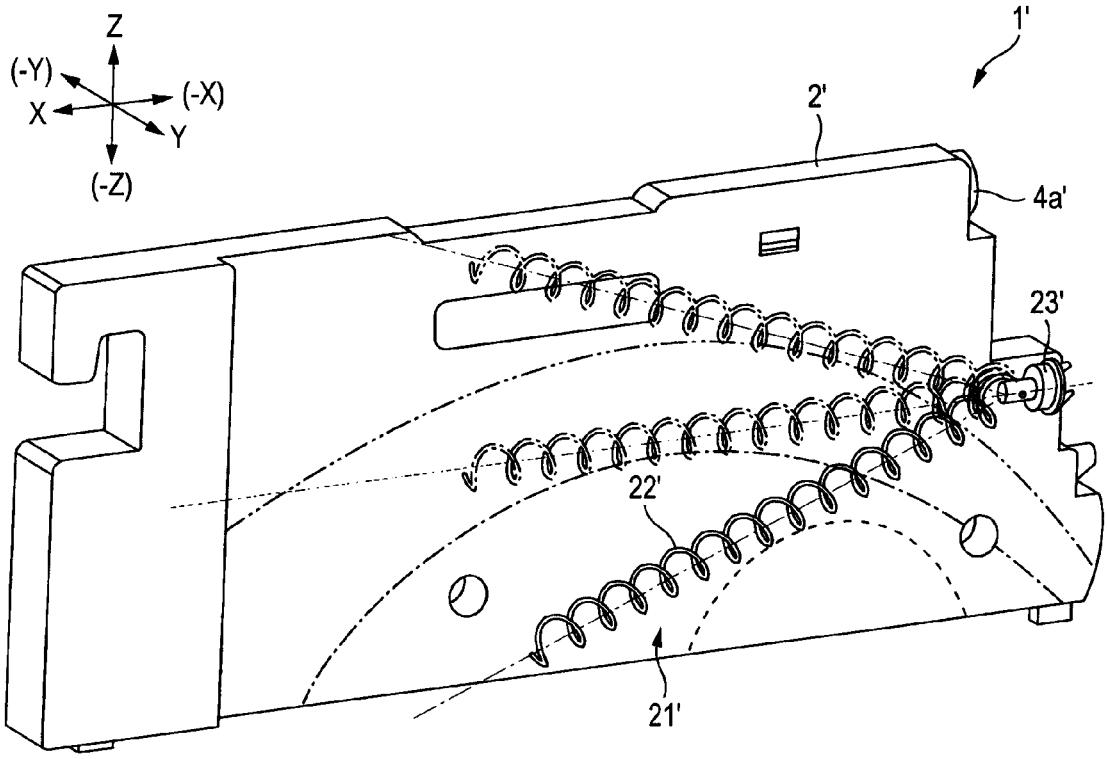
FIG. 9 is a view illustrating the developer container in Example 3 of the invention.

FIG. 9 is a view illustrating the developer container in Example 3 of the invention.

Figure 10A:
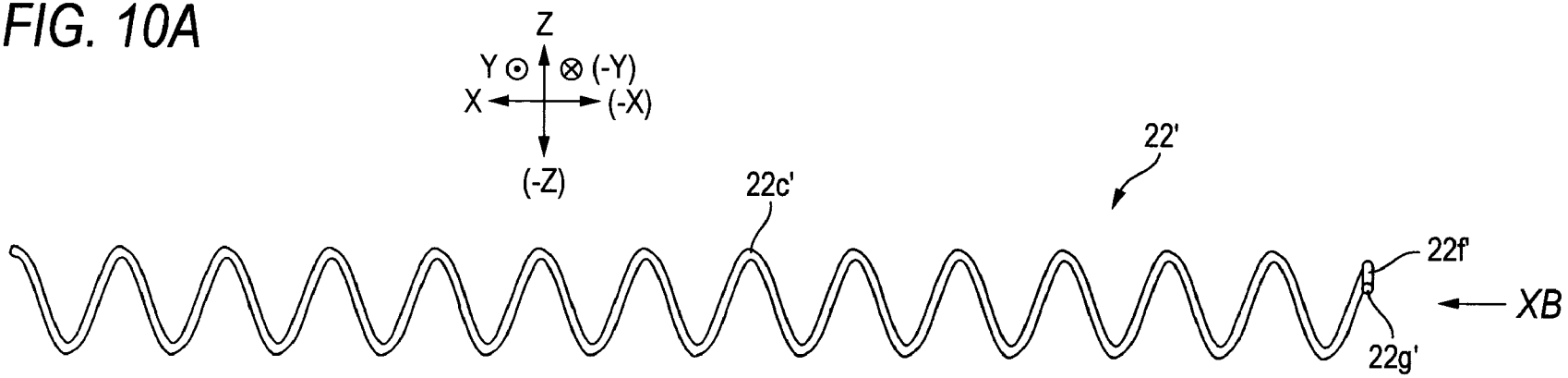
Figure 10B:
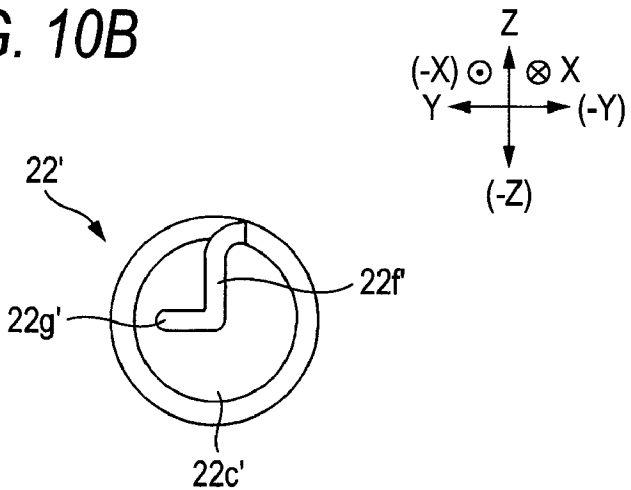
Figure 11B:
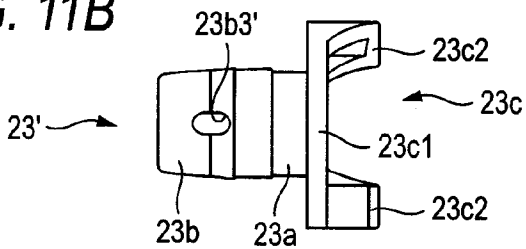
Figure 11A:
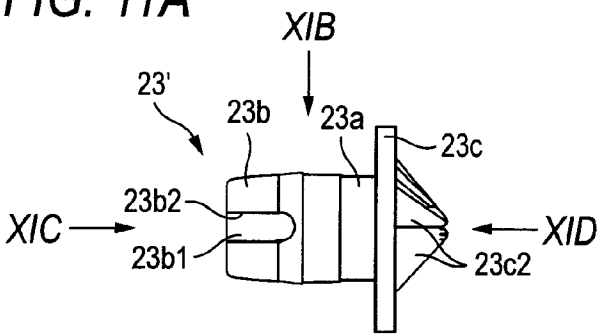
Figure 11D:
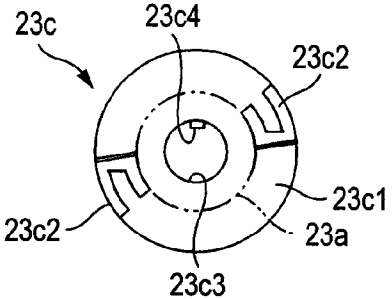
Figure 11C:
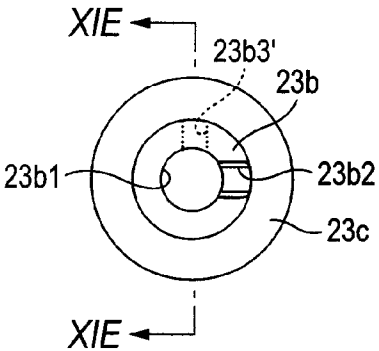
Figure 11E:
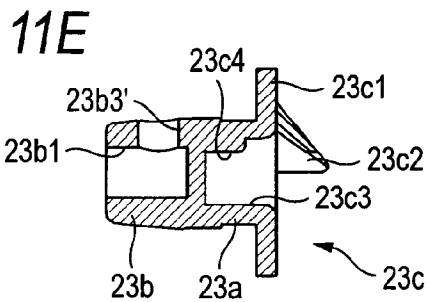

FIG. 10 is a view illustrating the conveying member body in Example 3 of the invention in which FIG. 10A is a side view of the conveying member body, and FIG. 10B is a view as seen in the direction of XB in FIG. 10A.

FIG. 11 is a view illustrating the end-portion supporting member in Example 3 of the invention corresponding to FIG. 4 of Example 1. In the figure, FIG. 11A is a side view, FIG. 11B is a view as seen in the direction of XIB in FIG. 11A, FIG. 11C is a view as seen in the direction of XIC in FIG. 11A, FIG. 11D is a view as seen in the direction of XID in FIG. 11A, and FIG. 11E is a section view taken along the line XIE-XIE in FIG. 11C.

Referring to FIG. 8, a recovery container 1' which is an example of a developer container in Example 3 is placed below the circulate conveying path SH3 and on the right side of the sheet feeding trays TR2 to TR4. A waste developer recovered by the photosensitive member cleaner CL1, the belt cleaner CLB, and the like is conveyed by a waste-developer conveying member which is not shown, and then recovered.

Referring to FIGS. 8 to 11, in the recovery container 1', a container body 2' has a vertically elongated box-like shape. An inflow port 4*a*' which is connected to the waste-developer conveying member, and into which the waste developer flows is formed in an upper end portion of the rear side (−X side) of the container body 2'. A conveying member 21' is rotatably supported on a vertically central portion of the rear side.

Referring to FIGS. 9 and 10, a conveying member body 22' in Example 3 has: a helical conveying portion 22*c*' which extends toward one end side; a second radiation direction extending portion 22*f*' which extends from a rear end portion (−X end-portion) of the conveying portion 22*c*' toward the rotation center, i.e., in the second radiation direction; and a first radiation direction extending portion 22*g*' which extends from a center portion of the second radiation direction extending portion 22*f*' in the first radiation direction perpendicular to the second radiation direction.

Referring to FIGS. 9 and 11, in an end-portion supporting member 23' in Example 3, a radiation-direction through hole 23*b*3' which is an example of a through hole is configured by a long hole that is axially elongated, in place of the radiation-direction through hole 23*b*3 of the end-portion supporting member 23 in Example 1.

(Method of Assembling Developer Conveying Member)

Figure 12C:
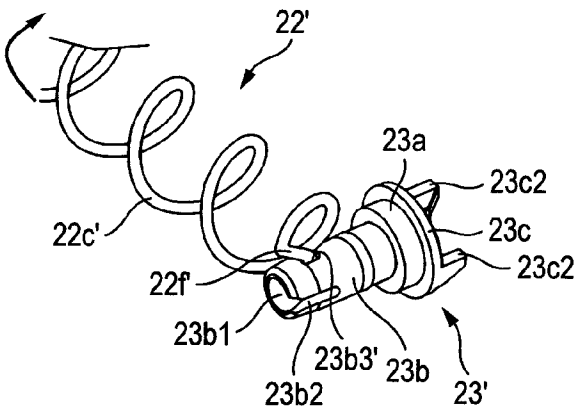
Figure 12B:
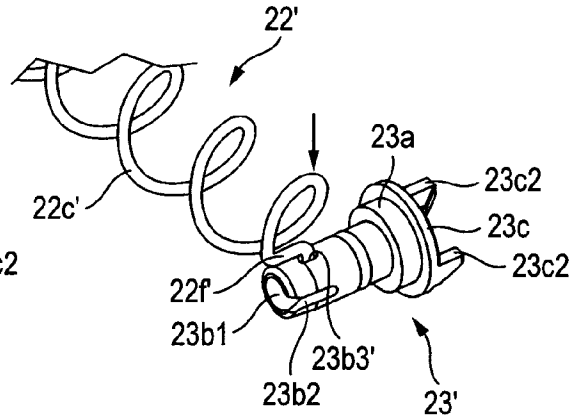
Figure 12A:
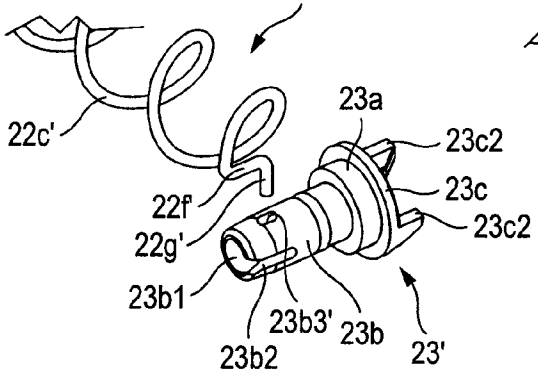
Figure 12E:
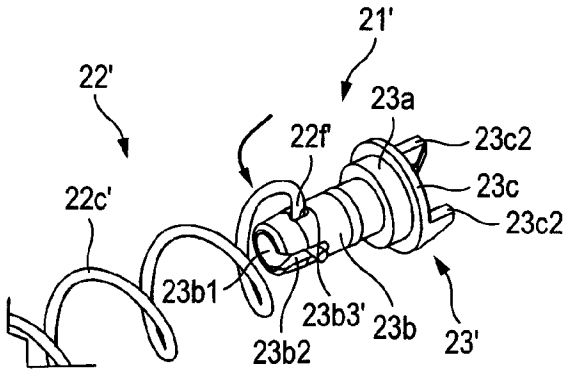
Figure 12D:
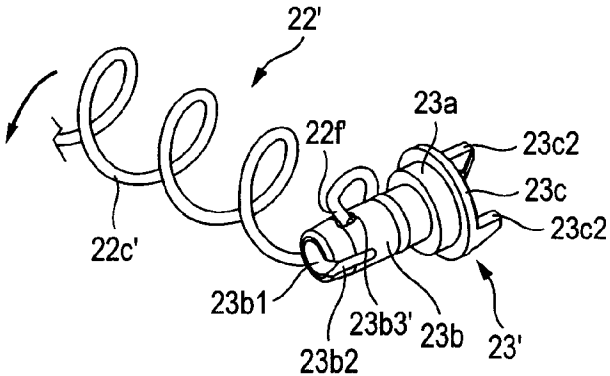

FIG. 12 is a view illustrating a method of assembling the developer conveying member in Example 3 of the invention in which FIG. 12A is a view illustrating a state where the conveying member body is separated from the end-portion supporting member, FIG. 12B is a view illustrating a state where, in the state shown in FIG. 12A, the first radiation direction extending portion is inserted into the radiation-direction through hole, FIG. 12C is a view illustrating a state where, in the state shown in FIG. 12B, the conveying member body is swung about the conveying portion, FIG. 12D is a view illustrating a state where, in the state shown in FIG. 12C, the conveying member body is further swung, and FIG. 12E is a view illustrating a state where, in the state shown in FIG. 12D, the conveying member body is swung about the radiation-direction through hole to be attached.

The manner of assembling the developer conveying member 21' will be described with reference to FIG. 12. In a state where the end-portion supporting member 23' is separated from the conveying member body 22' as shown in FIG. 12A, first, the first radiation direction extending portion 22*g*' is inserted into the radiation-direction through hole 23*b*3' of the end-portion supporting member 23' as shown in FIG. 12B. When the conveying member body is swung about the helical conveying portion 22*c*' in the state shown in FIG. 12B, the state shown in FIG. 12D is obtained via the state shown in FIG. 12C, and the first radiation direction extending portion 22*g*' enters into the axial recess 23*b*1. When the conveying member body 22' is swung about the radiation-direction through hole 23*b*3' in this state, the state shown in FIG. 12E is attained, the conveying member body 22' is attached to the end-portion supporting member 23', and the developer conveying member 21' is assembled. The developer conveying member 21' is attached to the container body 2' in this state, thereby performing the assembling process.

Function of Example 3

Figure 13A:
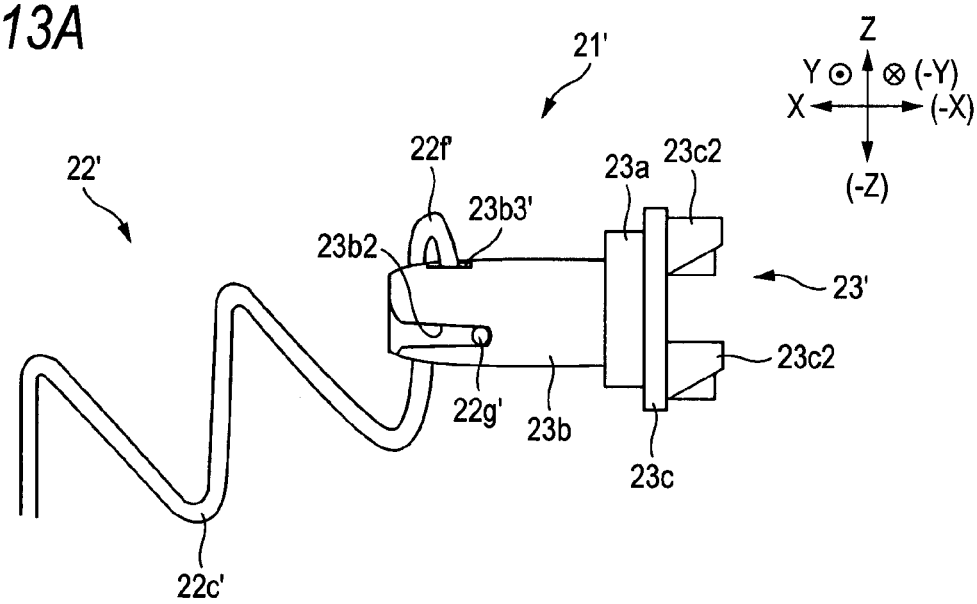
Figure 13B:
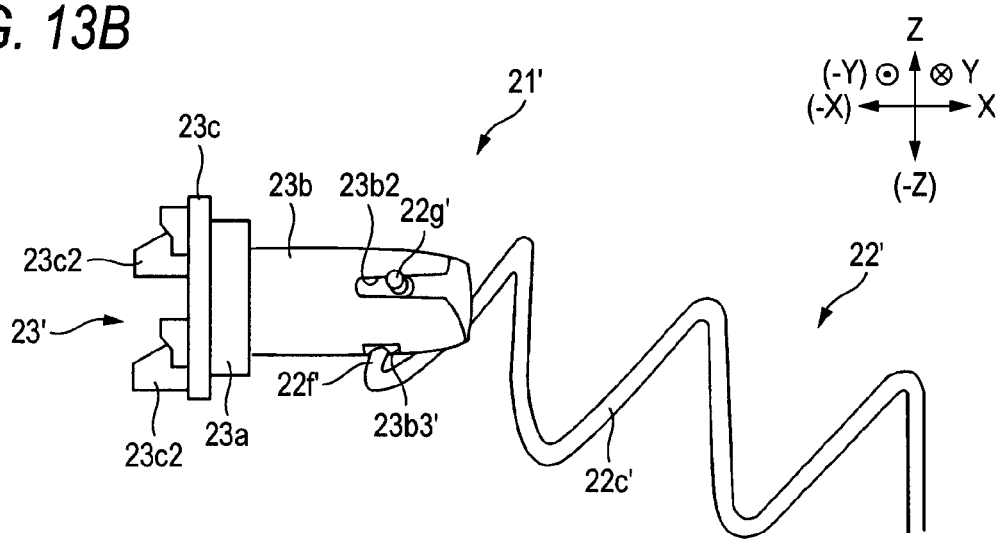

FIG. 13 is a view illustrating the rotation state of the conveying member in Example 3 in which FIG. 13A is a view illustrating a coupling portion between the end-portion supporting member and the conveying member body in the rotation state shown in FIG. 9, and FIG. 13B is a view illustrating a state where, in the state shown in FIG. 13A, the end-portion supporting member is rotated by 180 degrees.

Referring to FIGS. 9 and 13, in the recovery container 1' of Example 3 having the above-described configuration, in a state where the amount of the developer in the recovery container 1' is small, the free end of the conveying member body 22' is downward inclined by the own weight of the conveying member body 22' as indicated by the broken line in FIG. 9 and FIG. 13 because the radiation-direction through hole 23*b*3' through which the second radiation direction extending portion 22*f*' penetrates is formed into a long hole-like shape. When, in this state, the rotation is transmitted to the end-portion supporting member 23' and the developer conveying member 21' is rotated, the second radiation direction extending portion 22*f*' is reciprocally moved along the long-hole like radiation-direction through hole 23*b*3', and the first radiation direction extending portion 22*g*' is reciprocally moved along the axial groove 23*b*2 so that the free end side or the front end side of the conveying member body 22' is downward inclined by the gravity. Therefore, the developer conveying member 21' is rotated in the inclined state to convey the developer from the inflow port 4*a*' to the inner side or the front side (+X side).

When the amount of the developer in the recovery container 1' is increased, the inclination of the conveying member 21' is changed in accordance with the increase of the developer. When the developer reaches the level indicated by the one-dot chain line in FIG. 9, the conveying member 21' becomes horizontal, and, when the developer reaches the level indicated by the two-dot chain line in FIG. 9, the conveying member 21' is upward inclined so that the developer is conveyed to the inner side. Therefore, the developer is conveyed while the inclination angle the conveying member 21' is automatically changed in accordance with the amount of the developer.

Example 4

Figure 14:
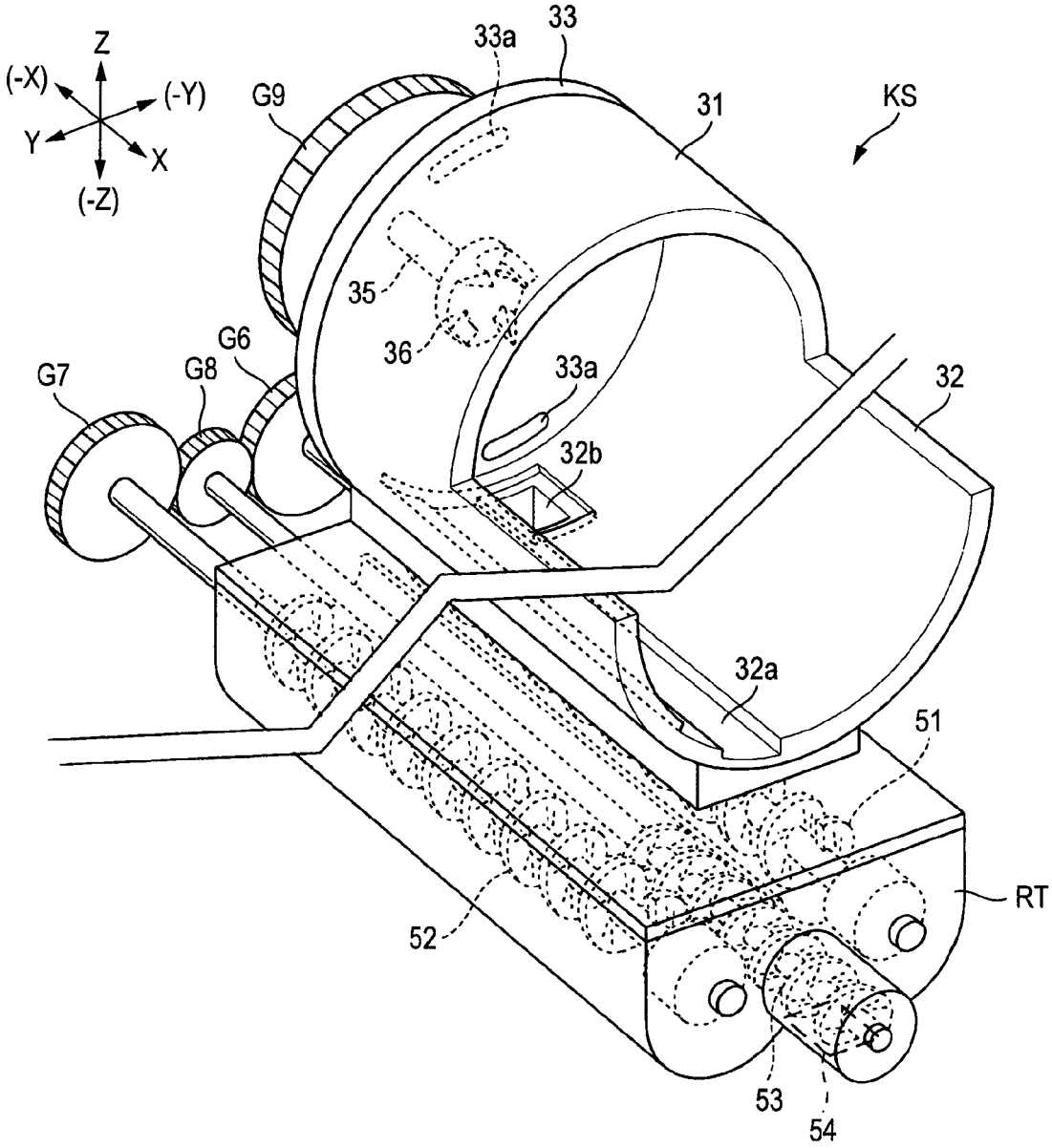
FIG. 14 is a view illustrating a replenishment container attaching member of an image forming apparatus of Example 4 of the invention.

FIG. 14 is a view illustrating a replenishment container attaching member of an image forming apparatus of Example 4 of the invention.

Figure 15:
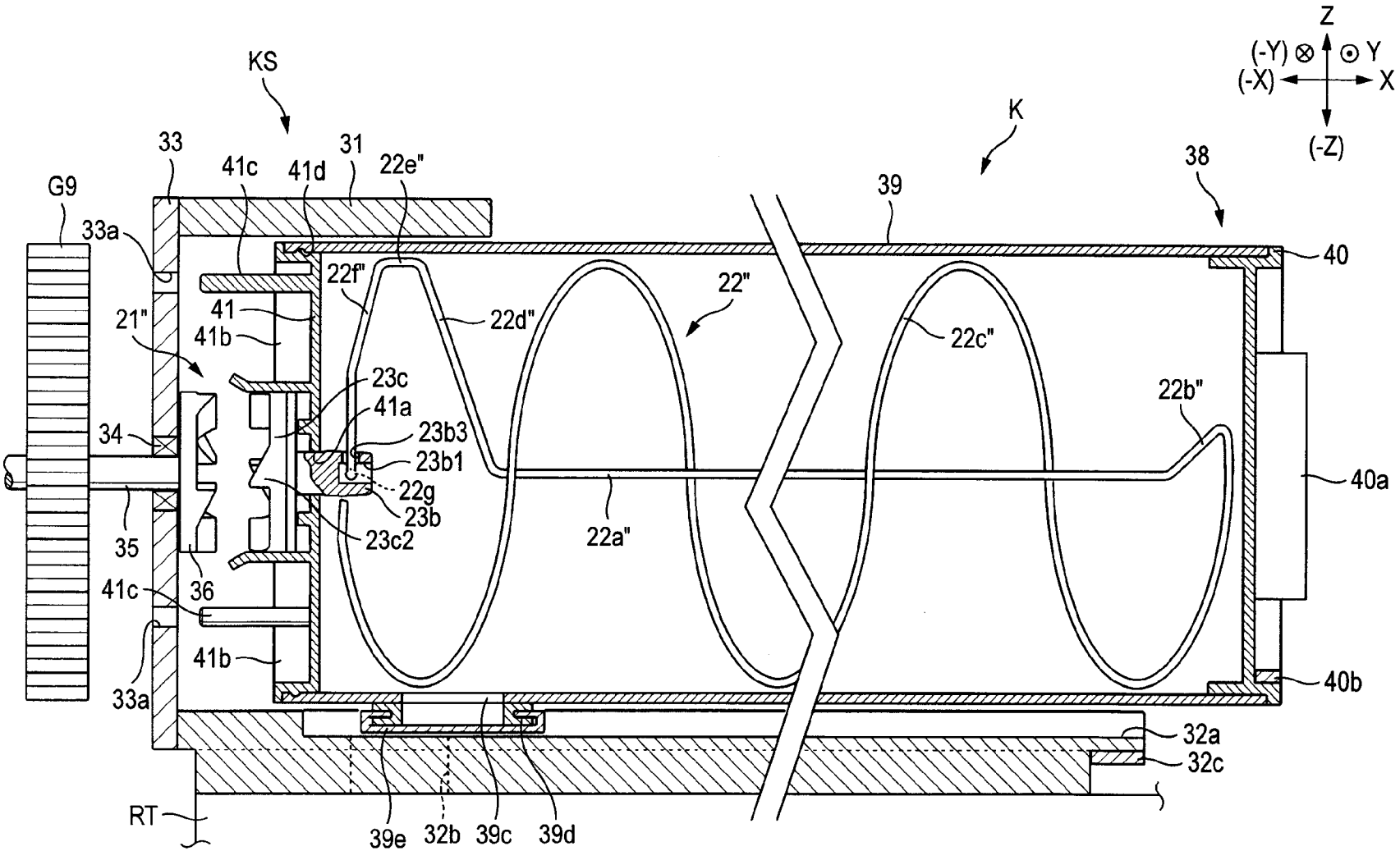
FIG. 15 is a section view illustrating a developer replenishment container which is an example of a developer container of the image forming apparatus of Example 4 of the invention, and a replenishment container attaching member.

FIG. 15 is a section view illustrating a developer replenishment container which is an example of a developer container of the image forming apparatus of Example 4 of the invention, and the replenishment container attaching member.

Figure 16:
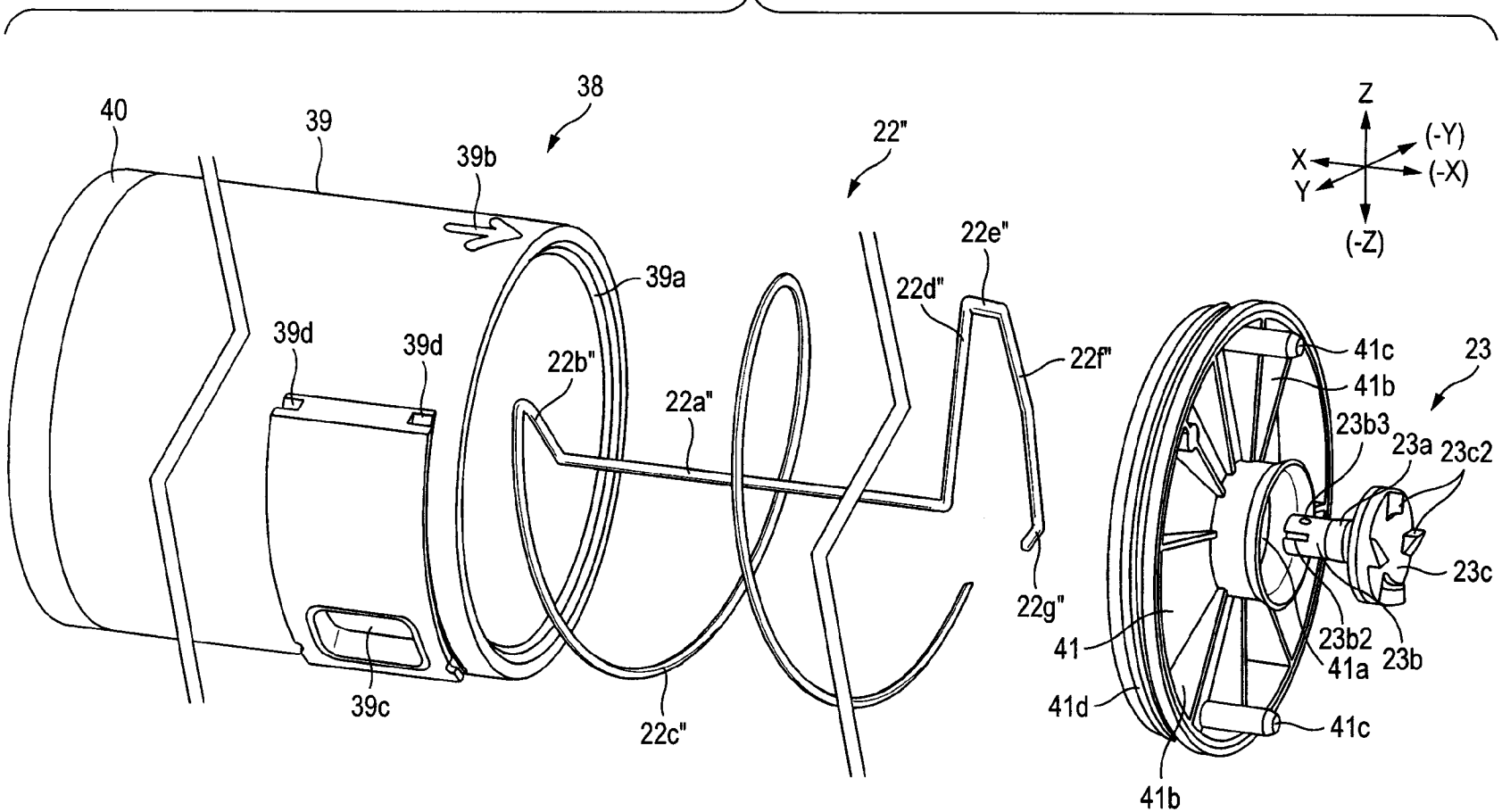
FIG. 16 is an exploded view of the developer replenishment container of Example 4.

FIG. 16 is an exploded view of the developer replenishment container of Example 4.

Next, Example 4 of the invention will be described. In the description of Example 4, the components corresponding to those of Example 3 are denoted by the same reference numerals, and their detailed description is omitted.

Example 4 is configured in the same manner as Example 3 except following points.

Referring to FIGS. 8 and 14 to 16, in Example 4 of the image forming apparatus U, the developer cartridge K which is an example of a developer cartridge is detachably attached to the cartridge attaching member KS. The cartridge attaching portion KS has a rear cylindrical portion 31, a front semicircular portion 32, and a rear end wall 33. A guide groove 32*a* which extends in the front and rear directions, and a replenishment port 32*b* which is connected to the rear end of the guide groove 32*a* are formed in a lower portion of the inner face of the front semicircular portion 32.

Two arcuate positioning pin insertion holes 33*a*, 33*a* are formed in the rear end wall 33. A rotation shaft 35 is rotatably supported on a central portion of the rear end wall 33 via a bearing 34. A coupler 36 is fixed to the front end of the rotation shaft 35 which penetrates through the rear end wall 33, and a gear G9 is fixed to the rear end.

Referring to FIG. 15, the developer cartridge K which is an example of a developer container that is detachably attached to the cartridge attaching portion KS has a developer containing vessel 38 which houses a replenishment developer. The developer containing vessel 38 has: a cylindrical vessel body 39; a front end wall 40 which is undetachably fixed to the front end of the vessel body 39; and a rear end wall 41 which is detachably supported on the rear end of the vessel body 39.

Referring to FIG. 16, a ring-like attachment groove 39*a* is formed in the inner circumferential face of the rear side of the vessel body 39, and a support indication 39*b* indicating the attachment direction is formed on a rear circumferential face. Referring to FIGS. 15 and 16, an opening 39*c* which is an example of a developer port for discharging the developer, guide rails 39*d* which are an example of an guiding member circumferentially extending, and a shutter 39*e* which is an example of an opening closing member that is guided by the guide rails 39*d*, and that is circumferentially movable are disposed in the outer circumferential face of a rear portion of the vessel body 39.

Referring to FIG. 15, an operation handle 40*a* is disposed on the front face of the front end wall 40. A storage medium

40*b* which stores information relating to the developer cartridge K, such as information indicative of whether the cartridge is a new one or empty, or so-called CRUM (Customer Replaceable Unit Memory) is detachably supported on the front end wall 40. At the timing when the developer cartridge K is attached, the information stored in the storage medium 40*b* is read and written in contactless radio communication by an information reading member 32*c* of the cartridge attaching portion KS.

Referring to FIGS. 15 and 16, a through hole 41*a* which penetrates in the front and rear directions, plural reinforcement ribs 41*b* which radially extend from the through hole 41*a* on the rear face of the rear end wall 41, and positioning pins 41*c*, 41*c* which are rearward projected in an outer circumferential portion of the rear face of the rear end wall 41 are formed on the rear end wall 41. A ring-like attachment convex portion 41*d* which is formed correspondingly with the attachment groove 39*a* is formed in the outer circumferential face of the rear side of the rear end wall 41. The attachment convex portion 41*d* is fitted into the attachment groove 39*a*, thereby attaching the rear end wall 41 to the vessel body 39.

The end-portion supporting member 23 which is configured in the same manner as that of the case of Example 1 except that the number of the engaging claws 23*c*2 is four is rotatably attached to the through hole 41*a*. Therefore, the engaging claws 23*c*2 engage with the coupler 36 to transmit the driving force.

A conveying member body 22" in Example 4 is supported on the end-portion supporting member 23. In the same manner as the conveying member body 22 in Example 1, the conveying member body 22" in Example 4 has: a body rod-like portion 22*a*" which extends in the axial direction; a coupling portion 22*b*" which obliquely extends in a radiation direction with respect to the rotation axis; a helical conveying portion 22*c*" which rearward extends from the outer end of the coupling portion 22*b*"; a second radiation direction bent portion 22*d*" which extends in the second radiation direction from the rear end of the body rod-like portion 22*a*"; an axial extending portion 22*e*" which axially extends from an external end portion in a radiation direction of the second radiation direction bent portion 22*d*"; a second radiation direction extending portion 22*f*" which extends toward the rotation center along a second radiation direction from the left end of the axial extending portion 22*e*"; and a first radiation direction extending portion 22*g*" which extends in a first radiation direction from the side of the rotation center of the second radiation direction extending portion 22*f*".

A conveying member 21" in Example 4 is configured by the end-portion supporting member 23 and the conveying member body 22".

Referring to FIGS. 14 to 16, when the developer cartridge K is inserted from the front toward the rear side, the guide rails 39*d* and shutter 39*e* of the developer cartridge K are rearward moved with being guided by the guide groove 32*a* of the cartridge attaching portion KS. When, in the state of FIG. 15, the developer cartridge K is further rearward inserted, the pins 41*c*, 41*c* are inserted into the arcuate positioning pin insertion holes 33*a*, 33*a*. In the inserted state, the end-portion supporting member 23 of the developer cartridge K is coupled to the coupler 36 of the cartridge attaching portion KS.

When, in the inserted state, the developer cartridge K is swung, the developer containing vessel 38 and the guide rails 39 are swung while the shutter 39*e* is not swung or remains to stop. At this time, the opening 39*c* is swingingly moved to a position where the opening communicates with the replenishment port 32*b*. Since the replenishment port 32*b* is coupled to the interior of the reserve tank RT, the replenishment developer in the developer cartridge K can be replenished into the reserve tank RT via the opening 39*c* and the replenishment port 32*b*.

The developer which is replenished into the reserve tank RT is circulatingly conveyed to be stirred by a pair of circulation conveying members 51, 51, and a part of the developer is discharged by a discharging member 53 through a discharge port 54 and conveyed by the developer conveying device GH to the developing device G to be replenished.

(Method of Assembling Developer Cartridge)

Referring to FIGS. 14 to 16, in the case where the developer cartridge K in Example 4 is to be assembled, in a state where the end-portion supporting member 23 is attached to the rear end wall 41, first, the conveying member body 22" is attached to the end-portion supporting member 23 in the same procedure as the case shown in FIG. 5 of Example 1, thereby assembling the developer conveying member 21". In a state where the developer is housed in the vessel body 39, next, the rear end wall 41 having the developer conveying member 21" is attached to the vessel body 39, thereby assembling the developer cartridge K.

(Method of Regenerating Used Developer Cartridge)

In the case where the developer cartridge K which has been used and became empty is to be generated, first, the rear end wall 41 into which the developer conveying member 21" is incorporated is detached from the vessel body 39.

Next, the conveying member body 22" is detached from the end-portion supporting member 23, and also the end-portion supporting member 23 is detached from the rear end wall 41. At this time, also the shutter 39*e* of the vessel body 39, and the storage medium 40*b* attached to the front end wall 40 are detached, and disassembled.

Next, the developer adhering to the interior of the vessel body 39, and the members such as the rear end wall 41 and the conveying member body 22" is cleaned away.

In the same manner as the method of assembling the developer cartridge, thereafter, the developer cartridge K is assembled. At this time, the information stored in the storage medium 40*b* is initialized and updated, and then attached to the developer cartridge K.

As a result, the used developer cartridge K is regenerated.

Function of Example 4

In the image forming apparatus U of Example 4 having the above-described configuration, like Example 1, the end-portion supporting member 23 in which the radiation-direction through hole 23*b*3 is formed is used as the developer conveying member 21 of the developer cartridge K. Therefore, it is possible to reduce occasions where the conveying member body 22" is separated when the developer cartridge K is transported, subjected to a work, or dropped.

(Modifications)

Although, in the above, the examples of the invention have been described in detail, the invention is not restricted to the examples. Various modifications are enabled within the scope of the spirit of the invention set forth in the claims. Modifications (H01) to (H06) of the invention will be exemplified.

(H01) In the examples, a printer is exemplified as the image forming apparatus. The invention is not restricted to this. The image forming apparatus may be configured as a facsimile apparatus, a copier, or a multifunction machine having all or plural functions of such apparatuses. The invention is not restricted to a color image forming apparatus, and can be configured also by a monochrome image forming apparatus. The invention is not restricted to a so-called rotary image forming apparatus, and can be applied also to an image forming apparatus of the tandem type or the like, (H02) In the examples, a recovery container into which a developer to be discarded is recovered is exemplified as the developer container. The invention is not restricted to this. For example, the invention can be applied also to developer conveying members in the developing devices GK, GY, GM, GC, or those which transport a developer to a recovery container from the image-carrier cleaner CL1, the belt cleaner CLB, and the secondary transferring roll cleaner CLt. In an image forming apparatus comprising a reserve container in which a developer is temporarily reserved, or a so-called dispenser, moreover, the invention can be applied also to such a container.

(H03) In the examples, the case where the invention is applied to a replaceable developer container is exemplified. The invention is not restricted to this. The invention can be applied also to a developer conveying member incorporated into an image forming apparatus. Namely, such a member can be prevented from being detached by, for example, a shock during a process of assembling the image forming apparatus.

(H04) In the examples, the combination of the conveying member body and the end-portion supporting member is not restricted to the combinations exemplified in Examples 1 to 3. The end-portion supporting member in Example 1 may be combined with the conveying member body in Example 3, and vice versa.

(H05) In the examples, the shape of the conveying member body is not restricted to the shapes exemplified in Examples 1 to 4, and the conveying member body can have an arbitrary shape. For example, the conveying member body can be configured by a conveying member in which a rotation shaft and a conveying vane disposed on the outer circumference are disposed, or a so-called auger, and the first and second radiation direction extending portions and the like in Examples 1 to 3 can be disposed in an end portion of the rotation shaft.

(H06) In the examples, the case where the first radiation direction is perpendicular to the second radial direction is exemplified. The invention is not restricted to this. The directions can be arbitrarily changed in accordance with the design or the like. For example, the directions can form an angle which is slightly different from 90 degrees.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A developer conveying member comprising:

a conveying member body that is rotated about a rotation axis to convey a developer in a conveying direction;

an end-portion supporting member that supports the conveying member body and rotates; and a supported member of the conveying member body, the supported member being supported by the end-portion supporting member, the supported member including:

a first radiation direction extending portion that extends in a first radial direction from the rotation axis of the conveying member body; and a second radiation direction extending portion that is formed continuously with an inner end portion of the first radiation direction extending portion in the first radial direction, and that extends in a second radial direction from the rotation axis of the conveying member body, the second radial direction being inclined with respect to the first radial direction, the end-portion supporting member including:

a cylindrical portion that includes a supporting portion supporting the supported member of the conveying member body, and the supporting portion including:

a through hole that supports the second radiation direction extending portion, that is formed penetratingly from an axial recess to an outside of the cylindrical portion in the second radial direction, and that has an outer diameter that is larger than outer diameters of the first and second radiation direction extending portions; and a groove that supports the first radiation direction extending portion, that is formed penetratingly from an axial recess to an outside of the cylindrical portion in the first radial direction, and that is formed until an end portion of the cylindrical portion with a width being larger than the outer diameter of the first radiation direction extending portion.

2. The developer conveying member as claimed in claim 1, further comprising:

a driving receiving portion that receives a driving force for rotation in a rotation direction, and wherein an angle from the through hole to the groove in the rotation direction is substantially larger than an angle from the groove to the through hole in the rotation direction, the rotation direction being a rotation direction of the driving receiving portion.

3. The developer conveying member as claimed in claim 1, wherein the conveying member body comprises:

a body rod-like portion that extends in an axial direction;

a helical conveying portion that is formed on a first end side of the rod-like portion;

a second radiation direction bent portion that is formed on a second end side of the rod-like portion in the second radial direction;

an axial extending portion that is formed continuously with second radiation direction bent portion, wherein the second radiation direction extending portion is formed continuously with the axial rod-like portion, and wherein the first radiation direction extending portion is formed continuously with the second radiation direction extending portion.

4. The developer conveying member as claimed in claim 1, wherein the conveying member body comprises:

a helical conveying portion that extends on a first end side of the conveying member body;

wherein the second radiation direction extending portion is formed continuously with a second end side of the conveying member body; and wherein the first radiation direction extending portion is formed continuously with the second radiation direction extending portion.

5. The developer conveying member as claimed in claim 1, wherein the end-portion supporting member includes the through hole defined by a long hole.

6. The developer conveying member as claimed in claim 1, wherein the axial groove comprises a fit fixing portion that performs fixation in a state where the first radiation direction extending portion is fitted.

7. A developer container comprising:

a developer containing vessel that includes a developer port through which the developer passes, and that contains the developer therein; and a developer conveying member according to claim 1 that is disposed in the developer containing vessel, and that conveys the developer in the vessel.

8. An image forming apparatus comprising:

a developer container according to claim 7 that is attachable to and detachable from an image forming apparatus body.

9. A method of assembling a developer conveying member, the method comprising:

inserting a first radiation direction extending portion that is formed in an end portion of a conveying member body, and that extends in a first radial direction with respect to a rotation axis direction, into a through hole formed penetratingly from an axial recess to an outside in a second radial direction, the axial recess being formed in a cylindrical portion of an end-portion supporting member and extending in the rotation axis direction;

relatively moving the conveying member body with respect to the end-portion supporting member, to move the first radiation direction extending portion of the conveying member body, to a state where the first radiation direction extending portion extends from the through hole to the an interior of the axial recess in the rotation axis direction; and relatively moving the conveying member body with respect to the end-portion supporting member, to fit the first radiation direction extending portion of the conveying member body, into a groove that extends from the axial recess of the end-portion supporting member along an outer circumference of the cylindrical portion in the rotation axis direction, and that is formed penetratingly from the axial recess to an outside in the first radial direction, thereby attaching the conveying member body to the end-portion supporting member.

10. The developer conveying member as claimed in claim 2, wherein the conveying member body comprises:

a body rod-like portion that extends in an axial direction;

a helical conveying portion that is formed on a first end side of the rod-like portion;

a second radiation direction bent portion that is formed on a second end side of the rod-like portion in the second radial direction;

an axial extending portion that is formed continuously with the second radiation direction bent portion;

wherein the second radiation direction extending portion is formed continuously with the axial rod-like portion; and wherein the first radiation direction extending portion is formed continuously with the second radiation direction extending portion.

11. The developer conveying member as claimed in claim 2, wherein the conveying member body comprises:

a helical conveying portion that extends on a first end side of the conveying member body;

wherein the second radiation direction extending portion is formed continuously with the conveying member body; and wherein the first radiation direction extending portion is formed continuously with the second radiation direction extending portion.

* * * * *